US008739885B2

(12) United States Patent
Shaw et al.

(10) Patent No.: US 8,739,885 B2
(45) Date of Patent: Jun. 3, 2014

(54) DEBRIS BARRIER FOR HYDRAULIC DISCONNECT TOOLS

(75) Inventors: Joel D. Shaw, Houston, TX (US); Greg Marshall, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 13/210,019

(22) Filed: Aug. 15, 2011

(65) Prior Publication Data

US 2013/0043038 A1 Feb. 21, 2013

(51) Int. Cl.
*E21B 34/06* (2006.01)
*E21B 34/00* (2006.01)
*E21B 17/00* (2006.01)

(52) U.S. Cl.
USPC ..... 166/373; 166/325; 166/242.6

(58) Field of Classification Search
USPC ..... 166/242.6, 325, 332.5, 373, 326
See application file for complete search history.

(56) References Cited

U.S. PATENT DOCUMENTS

| | | | | |
|---|---|---|---|---|
| 2,277,380 | A * | 3/1942 | Yancey | 166/74 |
| 3,216,466 | A * | 11/1965 | Simko | 141/226 |
| 3,433,455 | A | 3/1969 | Cook | |
| 4,460,156 | A * | 7/1984 | Hazelrigg et al. | 251/149.3 |
| 6,408,946 | B1 | 6/2002 | Marshall et al. | |
| 7,373,974 | B2 | 5/2008 | Connell et al. | |
| 7,640,977 | B2 | 1/2010 | Jonas | |
| 7,798,212 | B2 | 9/2010 | Bolze et al. | |
| 2011/0108266 | A1 | 5/2011 | Smith et al. | |
| 2012/0012327 | A1 * | 1/2012 | Plunkett et al. | 166/324 |

OTHER PUBLICATIONS

Filing receipt and specification for patent application entitled "Debris Barrier for Hydraulic Disconnect Tools," by Joel D. Shaw, et al., filed Oct. 2, 2012 as U.S. Appl. No. 13/633,736.
WellDynamics brochure H06979 entitled, "Concentric Electric Disconnect—Reliably Disconnect from the Lower Completion without Pulling the Entire Completion String," Aug. 2009, 2 pages, Halliburton.
WellDynamics brochure H06963 entitled, "Concentric Hydraulic Disconnect—Reliably Disconnect from ESP Applications without Pulling the Entire Completion," Aug. 2009, 2 pages, Halliburton.
Foreign communication from a related counterpart application—International Search Report and Written Opinion, PCT/US2012/050371, Mar. 5, 2013, 10 pages.
Office Action dated Jul. 9, 2013 (17 pages), U.S. Appl. No. 13/633,736, filed Oct. 2, 2012.
Office Action (Final) dated Jan. 27, 2014 (13 pages), U.S. Appl. No. 13/633,736 filed on Oct. 2, 2012.

* cited by examiner

*Primary Examiner* — Nicole Coy
*Assistant Examiner* — Michael Wills, III
(74) *Attorney, Agent, or Firm* — Scott Wendorf Conley Rose, P.C.

(57) ABSTRACT

A hydraulic connection mechanism for use in a wellbore comprises an upper connection running tool, a lower connection tool configured to engage the upper connection running tool and form a fluid communication pathway through the hydraulic connection mechanism, and a debris barrier disposed in the fluid communication pathway. The debris barrier comprises a body element, and a spring element configured to maintain the body element in a closed position when the upper connection running tool is disengaged from the lower connection tool.

19 Claims, 10 Drawing Sheets

DEBRIS BARRIER FOR HYDRAULIC DISCONNECT TOOLS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to recover of the hydrocarbons. Some wellbore servicing methods employ wellbore tubulars that are conveyed within the wellbore for various purposes throughout the life of the wellbore, such as producing the hydrocarbons from the wellbore. The wellbore tubulars may be retrieved from the wellbore for a variety of purposes. For example, the wellbore tubular may be retrieved from the wellbore in order to replace or repair the wellbore tubular, perform a servicing operation on the subterranean formation, or abandon the wellbore. Each time the wellbore tubular is placed into the wellbore or retrieved from the wellbore, the potential exists to damage the wellbore and/or the wellbore tubular, and is associated with a cost of operating a servicing or workover rig to convey the wellbore tubular. Some wellbore tubulars may be retrieved in components to allow a portion of the wellbore tubular to remain in the wellbore. However, the reconnection process when the wellbore tubular is redeployed within the wellbore can experience problems due to mechanical failures, less than perfect reconnections due to fouling of the components, and blockage of some components due to debris within the wellbore.

SUMMARY

In an embodiment, a hydraulic connection mechanism for use in a wellbore comprises an upper connection running tool; a lower connection tool configured to engage the upper connection running tool and form a fluid communication pathway through the hydraulic connection mechanism; and a debris barrier disposed in the fluid communication pathway. The debris barrier comprises a body element; and a spring element configured to maintain the body element in a closed position when the upper connection running tool is disengaged from the lower connection tool. The body element may comprise a debris barrier body and a latch member disposed within a groove within the lower connection tool, and the spring element may comprise a spring member comprising an extension of the debris barrier body that is configured to extend inward beyond an inner surface of the lower connection tool when the upper connection running tool is disengaged from the lower connection tool. The extension may be configured to engage the latch member in the closed position. The lower connection tool may also include a debris barrier body comprising a seat, and the body element may comprise an inner member disposed within a groove within the lower connection tool. A portion of the inner member may extend inward beyond an inner surface of the lower connection tool when the upper connection running tool is disengaged from the lower connection tool. The spring element may comprise a spring disposed within the lower connection tool that engages the inner member. The spring may be configured to bias the inner member into contact with the seat in the closed position. The body element may comprise a segmented debris barrier body comprising a plurality of body segments and may be disposed within a groove within the lower connection tool. A portion of the segmented debris barrier body may be configured to extend inward beyond an inner surface of the lower connection tool when the upper connection running tool is disengaged from the lower connection tool, and the spring element may comprise a spring element disposed within the lower connection tool that engages the segmented debris barrier body. The spring element may be configured to bias the plurality of body segments into an end-to-end configuration around an inner surface of the lower connection tool in the closed position. The body element may also comprise a poppet disposed within a flow passage within the lower connection tool, and the spring element may comprise a spring that engages the poppet and biases the poppet inward. A portion of the poppet may extend inward beyond an inner surface of the lower connection tool when the upper connection running tool is disengaged from the lower connection tool, and an inward edge of the flow passage may form a seat. The spring may be configured to bias the poppet into contact with the seat in the closed position. A portion of the poppet may be flush or recessed with respect to an inner surface of the lower connection tool, and the poppet may comprise an inner fluid valve. The inner fluid valve may comprise an inner spring that engages an inner body and biases the inner body outwards towards an inner seat. The poppet and the inner fluid valve may be configured to provide fluid communication through the debris barrier in response to a pressure differential in either direction across the debris barrier.

In an embodiment, a method of servicing a wellbore comprises providing a hydraulic connection mechanism within a wellbore, disengaging the upper connection running tool from the lower connection tool, allowing the debris barrier to close off the fluid communication pathway, re-engaging the upper connection running tool with the lower connection tool, and actuating the debris barrier to establish fluid communication through the fluid communication pathway. The hydraulic connection mechanism comprises: an upper connection running tool; a lower connection tool engaging the upper connection running tool, wherein a fluid communication pathway is formed through the hydraulic connection mechanism when the upper connection running tool engages the lower connection tool; and a debris barrier disposed in the fluid communication pathway. The debris barrier may be disposed in the fluid communication pathway within the lower connection tool, and the debris barrier may be mechanically actuated by an engagement with the upper connection running tool. The debris barrier may be hydraulically actuated by a pressure differential across the debris barrier. The method may also include a plurality of fluid communication pathways formed by the engagement of the upper connection running tool and the lower connection tool, where each debris barrier of a plurality of debris barriers may be disposed in each of the plurality of fluid communication pathways, wherein each debris barrier may be allowed to close off the corresponding fluid communication pathway; and wherein each debris barrier may be actuated to establish fluid communication through the corresponding fluid communication pathway.

In an embodiment, a method of actuating a debris barrier comprises providing a debris barrier disposed in a fluid communication pathway within a lower connection tool within a wellbore; engaging an upper connection running tool with the lower connection tool; actuating the debris barrier to displace a portion of a fluid in the fluid communication pathway; and establishing fluid communication between the upper connection running tool and the lower connection tool through the fluid communication pathway comprising the debris barrier. The debris barrier may be disposed in a groove within an inner surface of the lower connection tool, and/or the debris barrier may be disposed in a flow passage disposed within the lower connection tool. The debris barrier may form a seal in the fluid communication pathway when the upper connection running tool is disengaged from the lower connection tool.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
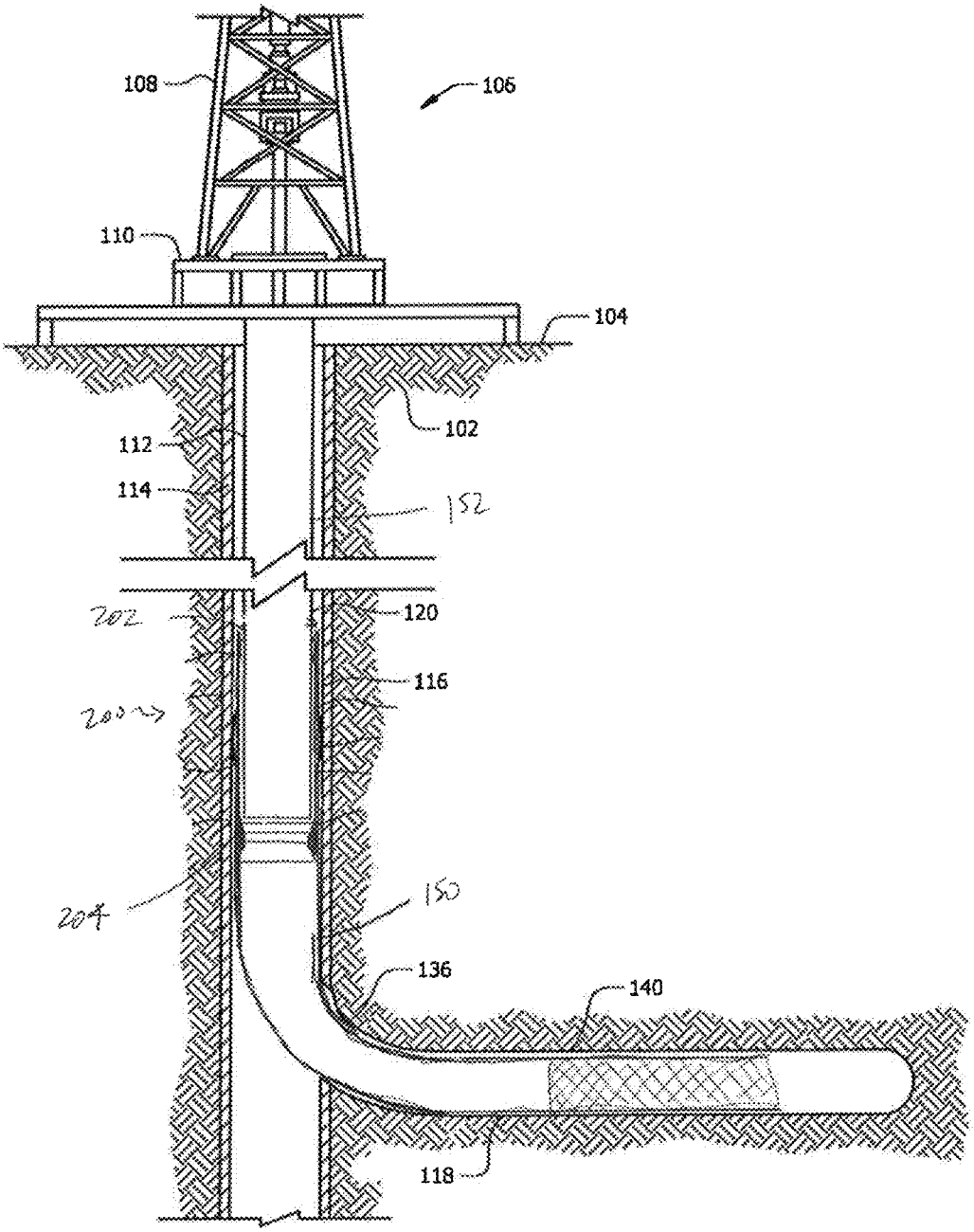
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center of the wellbore in a radial direction (i.e., towards the central axis of the wellbore and/or the hydraulic connection mechanism) and with "out," "outer," or "outward" meaning towards the wall of the well in a radial direction, regardless of the wellbore orientation. As used herein, "service," "servicing," or "servicing operation" refers to any operation or procedure used to drill, complete, work over, fracture, repair, or in any way prepare or restore a wellbore for the recovery of materials residing in a subterranean formation penetrated by the wellbore. A "servicing tool" refers to any tool or device used to service a wellbore or used during a servicing operation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells.

A wellbore tubular string 120 comprising a hydraulic connection mechanism 200 may be lowered into the subterranean formation 102 for a variety of servicing or treatment procedures throughout the life of the wellbore. The embodiment shown in FIG. 1 illustrates the wellbore tubular 120 in the form of a production tubing string being lowered into the subterranean formation with the upper connection running tool 202 engaging the lower connection tool 204. It should be understood that the wellbore tubular 120 comprising the hydraulic connection mechanism 200 is equally applicable to any type of wellbore tubular being inserted into a wellbore, including as non-limiting examples production tubing and coiled tubing. The hydraulic connection mechanism 200 may also be used to connect and provide a hydraulic pathway for various other downhole components (e.g., various downhole subs, pumps, and servicing tools). In the embodiment shown in FIG. 1, the wellbore tubular 120 comprising the upper connection running tool 202 is conveyed into the subterranean formation 102 in a conventional manner and engages the lower connection tool 204 to thereby establish one or more hydraulic pathways through the hydraulic connection mechanism 200.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 within the wellbore 114. For example, the wellbore tubular 120 may comprise the hydraulic connection mechanism 200 that is initially extended into the wellbore or the wellbore tubular 120 may comprise the upper connection running tool being extended into the wellbore 114 for engagement with the lower connection tool 204. While the operating environment depicted in FIG. 1 refers to a stationary drilling rig 106 for lowering and positioning the wellbore tubular 120 comprising the hydraulic connection mechanism 200 within a land-based wellbore 114, in alternative embodiments, mobile workover rigs, wellbore servicing units (such as coiled tubing units), and the like may be used to lower the wellbore tubular 120 comprising the hydraulic connection mechanism 200 into a wellbore. It should be understood that a wellbore tubular 120 comprising the hydraulic connection mechanism 200 may alternatively be used in other operational environments, such as within an offshore wellbore operational environment. In alternative operating environments, a vertical, deviated, or horizontal wellbore portion may be cased and cemented and/or portions of the wellbore may be uncased. For example, uncased section 140 may comprise a section of the wellbore 114 ready for being cased or used as an open-hole production zone. In an embodiment, a wellbore tubular 120 comprising the hydraulic connection mechanism 200 may be used in a cased or uncased wellbore.

Regardless of the type of operational environment in which the wellbore tubular 120 comprising the hydraulic connection mechanism 200 is used, it will be appreciated that the hydraulic connection mechanism 200 serves to provide a releasable connection that allows for one or more hydraulic pathways to be established between an upper connection running tool 202 and an lower connection tool 204. In an embodiment, the hydraulic connection mechanism 200 may also allow for one or more releasable electrical connections to be established. As described in greater detail below with respect to FIG. 2, the hydraulic connection mechanism 200 comprises an upper connection running tool 202 that releasably engages the lower connection tool 204. The upper connection running tool 202 may engage an upper wellbore tubular section 152 and the lower connection tool 204 may engage a lower wellbore tubular section 150. The hydraulic connection mechanism 200 may comprise one or more hydraulic connection mechanisms to allow a fluid to be directed from a hydraulic line in the upper connection running tool 202 to a corresponding hydraulic line in the lower connection tool 204. A fluid may then be directed through the hydraulic connection mechanism 200 when the upper connection running tool 202 is engaged with the lower connection tool 204 to provide a control signal or operating fluid to one or more components below the hydraulic connection mechanism 200.

Figure 2:
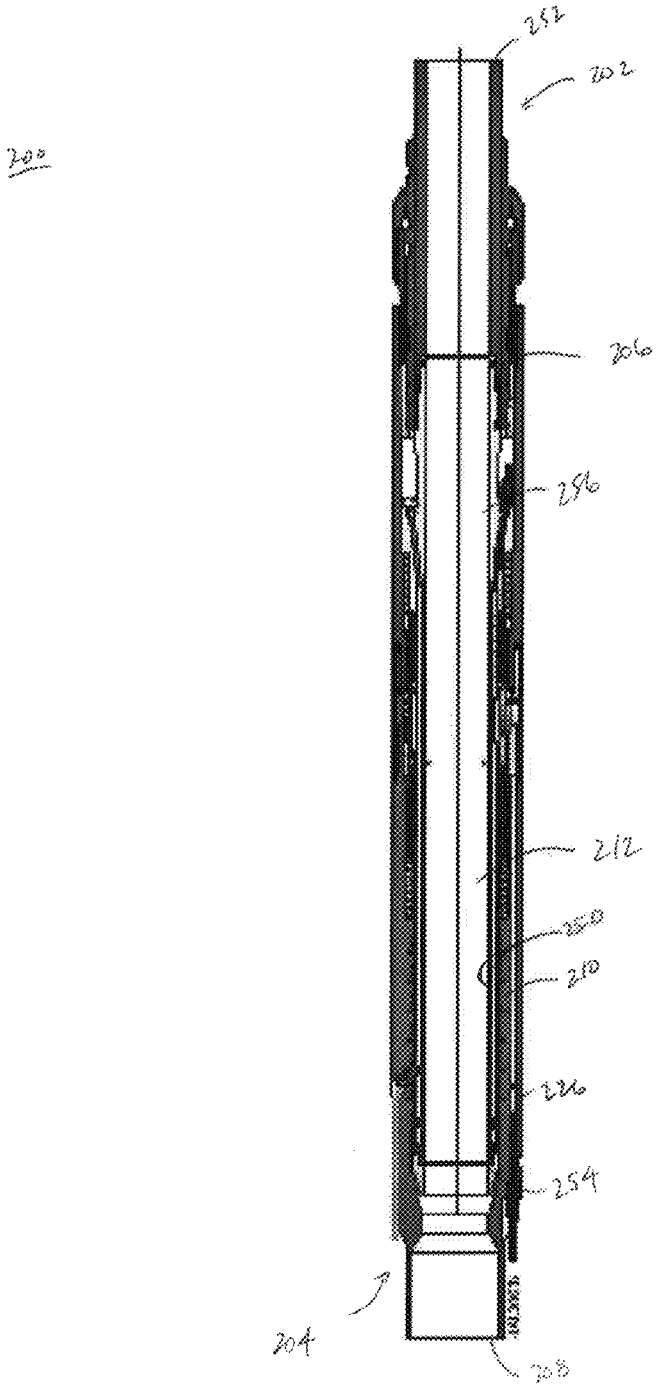
FIG. 2 is a cross-sectional view of a hydraulic connection mechanism according to an embodiment.

Referring now to FIG. 2, an embodiment of the hydraulic connection mechanism 200 is shown in cross-section. As described above, the hydraulic connection mechanism 200 comprises an upper connection running tool 202 that engages the lower connection tool 204. The lower connection tool 204 has two ends 206, 208 with a generally cylindrical outer body 210 extending therebetween. End 208 is the lower end of lower connection tool 204 and may be coupled to a wellbore tubular such as the lower wellbore tubular section 150. In an embodiment, the lower connection tool 204 may be coupled to a lower wellbore tubular through the use of a threaded connection at end 208. One or more sealing elements (element 264 of FIG. 3) may be used to provide a fluid tight connection between the lower connection tool 204 and the lower wellbore tubular section 150. End 206 may be coupled to the upper connection running tool 202, as further described herein.

Figure 3:
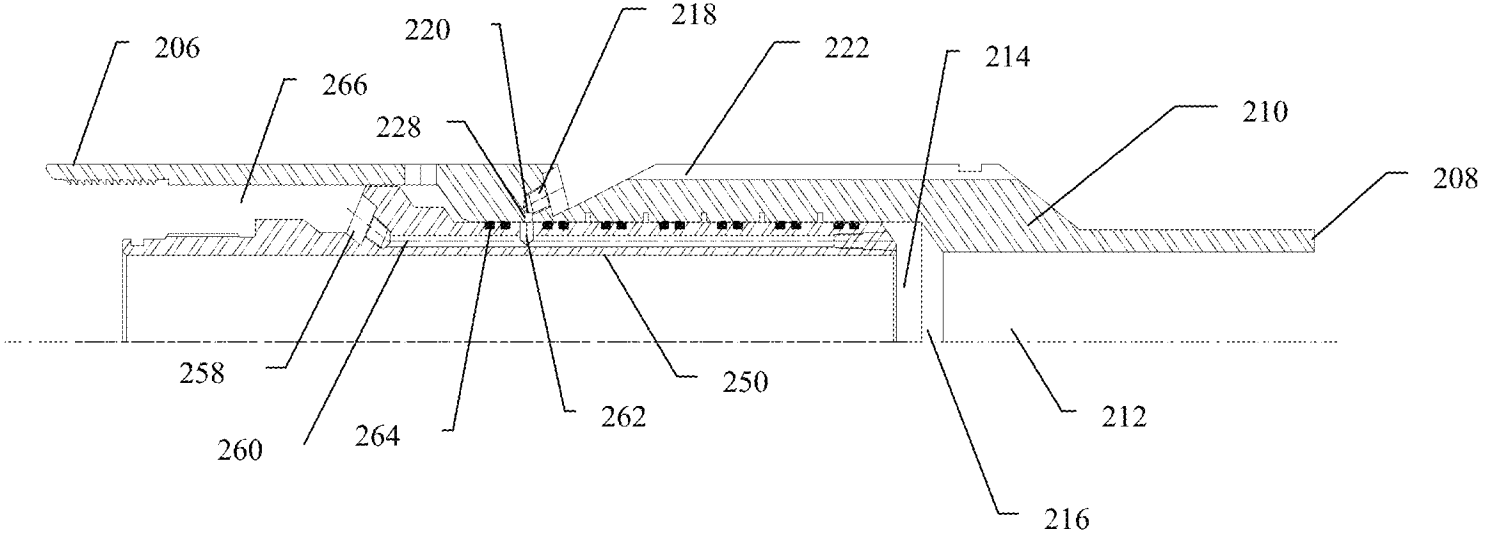
FIG. 3 is half cross-sectional view of a hydraulic connection mechanism according to another embodiment.

Referring to FIG. 2 and FIG. 3, the lower connection tool 204 has a flowbore 212 extending through the outer body 210 from end 208 and an increased diameter flowbore 214 extending therethrough from end 206 to flowbore 212. Flowbore 212 is smaller in cross-section than flowbore 214 and forms a shoulder 216 in outer body 210 at the transition between flowbore 212 and flowbore 214. Shoulder 216 may limit the extent to which the upper connection running tool 202 may translate within the lower connection tool 204. The size of the flowbore 212 may be selected to allow for fluid flow therethrough at a desired rate during normal operation of the wellbore tubular 120 and any associated components. The size and shape of the outer body 210 may be selected to receive the upper connection running tool 202, as described in more detail herein.

Referring to FIG. 3, one or more ports 218 may be formed in an outer surface of the outer body 210. In an embodiment, the one or more ports 218 may be coupled to one or more flow lines. A fluid passageway 220 may allow for fluid communication between each port 218 and an annular space between an interior surface of the outer body 210, the outer surface of the upper connection running tool 202, and one or more corresponding sealing elements 264 when the upper connection running tool 202 is engaged with the lower connection tool 204. A bypass slot 222 may be disposed on the generally cylindrical outer surface of the outer body 210 to receive and allow a flow line coupled to the port 218 to pass below the lower connection tool 204. In an embodiment, an outer mandrel (mandrel 226 of FIG. 2) may have a generally cylindrical inner surface and be disposed about the lower connection tool 204. The combination of the fluid passageway 220, the port 218, and the flow line may thus provide for fluid communication between the annular space formed between the interior surface of the outer body 210, the outer surface of the upper connection running tool 202, and one or more sealing elements 264 and one or more flow lines or conduits disposed below the hydraulic connection mechanism 200. In an embodiment, a plurality of fluid communication pathways may be formed from a plurality of fluid passageways 220, ports 218, and flow lines disposed and longitudinally spaced in combinations around the perimeter of the outer body 210. In an embodiment, the lower connection tool 204 may comprise 1 to about 10 such fluid communication pathways. In an embodiment, the lower connection tool 204 may comprise 6, 7, or 8 such fluid communication pathways.

In an embodiment, the inner surface of the outer body 210 may have a groove 228 disposed around the inner perimeter of the outer body 210. The fluid passageway 220 may extend between the port 218 and the groove 228 to provide a fluid communication therebetween. The groove 228 may have a size and shape configured to allow for fluid communication between the fluid passageway 220 and the inner perimeter of the outer body 210 along the length of the groove 228. In an embodiment with a plurality of fluid passageways 220, ports 218, and flow lines disposed in bypass slots 222, a plurality of grooves 228 may be disposed around the inner perimeter of the outer body 210 with each groove 228 corresponding in position to each fluid passageway 220 disposed in the outer body 210.

Returning to FIG. 2, the hydraulic connection mechanism 200 also comprises an upper connection running tool 202. The upper connection running tool 202 has two ends 252, 254 with a generally cylindrical inner body 250 extending therebetween. End 252 is the upper end of upper connection running tool 202 and may be coupled to a wellbore tubular such as the upper wellbore tubular section 152. In an embodiment, the upper connection running tool 202 may be coupled to an upper wellbore tubular section 152 through the use of a threaded connection at end 252. One or more sealing elements may be used to provide a fluid tight connection between the upper connection running tool 202 and the upper wellbore tubular section 152. End 254 may be coupled to the lower connection tool 204, as described herein.

The upper connection running tool 202 has a throughbore 256 extending through the inner body 250 from end 252 to end 254. The size of the flowbore 256 may be selected to allow for fluid flow therethrough at a desired rate during normal operation of the wellbore tubular 120 and any associated components. The size and shape of the inner body 250 may be selected to be received within the outer body 210 of the lower connection tool 204. The end 254 of inner body 250 may have a cross-section that is larger than the cross-section of flowbore 212 to allow the shoulder 216 to retain the upper connection running tool 202 above the shoulder 216. While not illustrated, additional alignment mechanisms and/or latching mechanisms may be used with the hydraulic connection mechanism 200 to align and retain the upper connection running tool 202 within the lower connection tool 204.

Referring to FIG. 3, one or more ports 258 may be formed in an outer surface of the inner body 250. In an embodiment, the one or more ports 258 may be coupled to one or more flow lines. A fluid passageway 260 may extend in a longitudinal direction (i.e., a direction generally parallel to the longitudinal axis of the upper connection running tool 202) through the inner body 250. The fluid passageway 260 is in fluid communication with a port 258 and extends from a point proximate the port 258 through the inner body 250. The fluid passageway 260 may not extend through the end 254 of the upper connection running tool 202. Alternatively, a plug or other fluid seal may be disposed in the fluid passageway 260 at the end 254 to prevent fluid communication between the fluid passageway and the exterior of the inner body 250 through the end 254. A channel 262 may be disposed in the inner body 250 to provide fluid communication between the fluid passageway 260 and the exterior of the inner body 250. One or more sealing elements 264, such as O-rings, may be disposed in a corresponding recess on an outer surface of the inner body 250. The sealing elements 264 may engage the inner surface of the outer body 210 to provide a fluid seal between the outer surface of the inner body 250 and the inner surface of the outer body 210. The sealing elements 264 may be disposed above and below the channel 262 to provide a fluid seal about the channel 262 when the upper connection running tool 202 is engaged with the lower connection tool 204. A recess 266 may be formed in the outer surface of the inner body 250 to receive a flow line coupled to the port 258, which may provide fluid communication between the port 258 and a fluid connection above the port 258. In an embodiment, one or more fluid connections may be in fluid communication with one or more flow lines disposed in the recess 266 to couple the port 258 to one or more hydraulic fluid lines or conduits disposed above the hydraulic connection mechanism 200. In an embodiment, a plurality of channels 262, fluid passageways 260, ports 258, and flow lines disposed in recesses 266 may be disposed in combinations around the perimeter of the inner body 250 to form a plurality of fluid communication pathways. In an embodiment the upper connection running tool 202 may comprise 1 to about 10 such fluid communication pathways. In an embodiment, the upper connection running tool 202 may comprise 6, 7, or 8 such fluid communication pathways. In an embodiment, the plurality of fluid communication pathways within the upper connection running tool may correspond in number and location to those formed in the lower connection tool 204.

Referring to FIG. 2 and FIG. 3, the hydraulic connection mechanism 200 is operated through engaging and disengaging the upper connection running tool 202 with the lower connection tool 204. When the upper connection running tool 202 is not engaged with the lower connection tool 204, the upper connection running tool 202 may be lowered into the lower connection tool 204 until end 254 of the upper connection running tool 202 engages the shoulder 216 and/or a latching mechanism disposed about the shoulder 216 of the lower connection tool 204. As the inner body 250 of the upper connection running tool 202 engages the outer body 210 of the lower connection tool 204, the sealing elements 264 engage the inner surface of the outer body 210 to provide a fluid seal between the inner body 250 and the outer body 210. When the upper connection running tool 202 is engaged within the lower connection tool 204, the sealing elements 264 may be aligned and configured to provide a sealed annular space about each fluid passageway 220 in the outer body 210 and each fluid passageway 262 in the inner body 250. Whether or not a groove is formed in the outer body 210, an annular gap between the outer surface of the inner body 250 and the inner surface of the outer body 210 can provide fluid communication between a fluid passageway 262 in the inner body 250 and the fluid passageway 220 in the outer body 210.

Thus in the engaged position, a fluid communication pathway is established between one or more hydraulic lines above the hydraulic connection mechanism 200 and one or more hydraulic lines below the lower connection tool 204. In this configuration, the fluid communication pathway is formed through the flow line disposed in recess 266, through the port 258, through the fluid passageway 260, through the channel 262, through the annular gap between the outer surface of the inner body 250, the inner surface of the outer body 210, and one or more corresponding sealing elements 264, through the optional groove 228, through the fluid passageway 220, through the port 218, and through the flow line disposed in the bypass slot 222. A plurality of pathways may be formed using a desired number of fluid communication pathways for each fluid communication channel. Further, the hydraulic connection mechanism 200 may provide a plurality of releasable hydraulic connections that are independent of the rotational alignment of the upper connection running tool 202 and the lower connection tool 204. Rather, the plurality of connections may be formed upon the engagement of the upper connection running tool 202 within the lower connection tool 204, which may longitudinally align the fluid passageways 262 in the upper connection running tool 202 with the corresponding fluid passageways 220 in the lower connection tool 204. This configuration may advantageously provide for a releasable connection that does not have to be aligned during coupling while still providing a consistent fluid communication pathway for use with one or more wellbore components below the hydraulic connection mechanism 200.

The upper connection running tool 202 may be removed for a variety of reasons during the life of the wellbore. In an embodiment, a one or more wellbore tools may be disposed above the hydraulic connection mechanism 200, and the wellbore tubular string may be removed from the wellbore to repair or replace the wellbore tool and/or the wellbore tubular string. During the time that the upper connection running tool 202 is not engaged with the lower connection tool 204, fluid may collect within the lower connection tool 204. The fluid can contain a variety of debris present in a subterranean wellbore. For example, the fluid may contain sand, sediment, precipitants, proppant particulates, oxidation products (e.g., rust from the various wellbore components), or other various solid, gelled, or viscous liquids. The debris may deposit within the grooves 228 and/or the fluid passageways 220 resulting in the blockage of the fluid communication pathway through the hydraulic connection mechanism 200 when the upper connection running tool 202 is engaged with the lower connection tool 204.

In order to prevent debris from entering and potentially clogging a groove 228 and/or a fluid passageway 220, a debris barrier may be disposed within a fluid communication pathway such as a groove 228 and/or a fluid passageway 220. The debris barrier may reduce the amount of debris that can enter the groove 228 and/or fluid passageway 220 when the upper connection running tool 202 is not engaged with the lower connection tool 204 while allowing for a fluid communication when the upper connection running tool 202 is engaged with the lower connection tool 204. In an embodiment, the debris barrier may comprise a body element and a spring element configured to maintain the body element in a closed position when the upper connection running tool is disengaged from the lower connection tool, though other configurations and designs are possible as discussed in more detail herein.

Figure 4A:
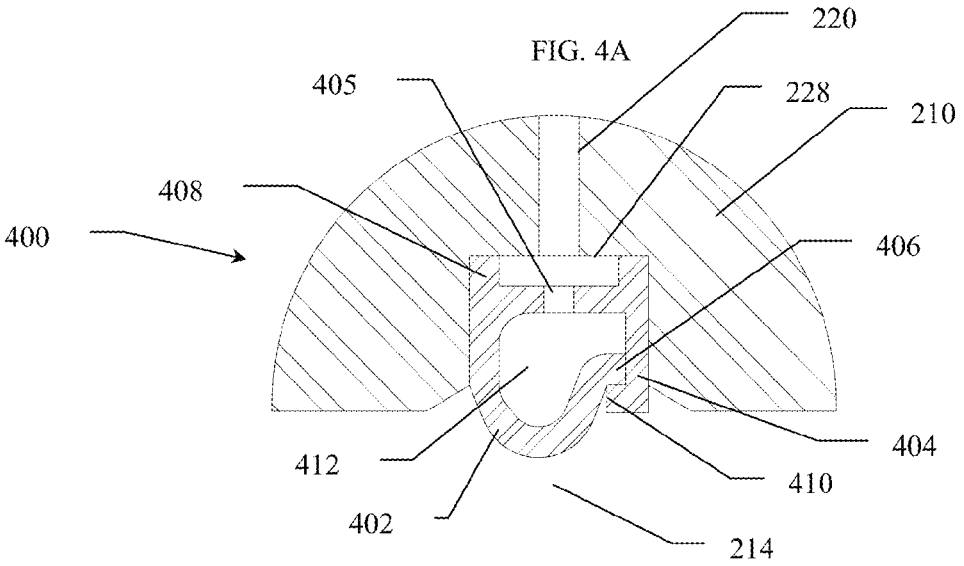
FIGS. 4A and 4B are cross-sectional views of a debris barrier according to an embodiment.
Figure 4B:
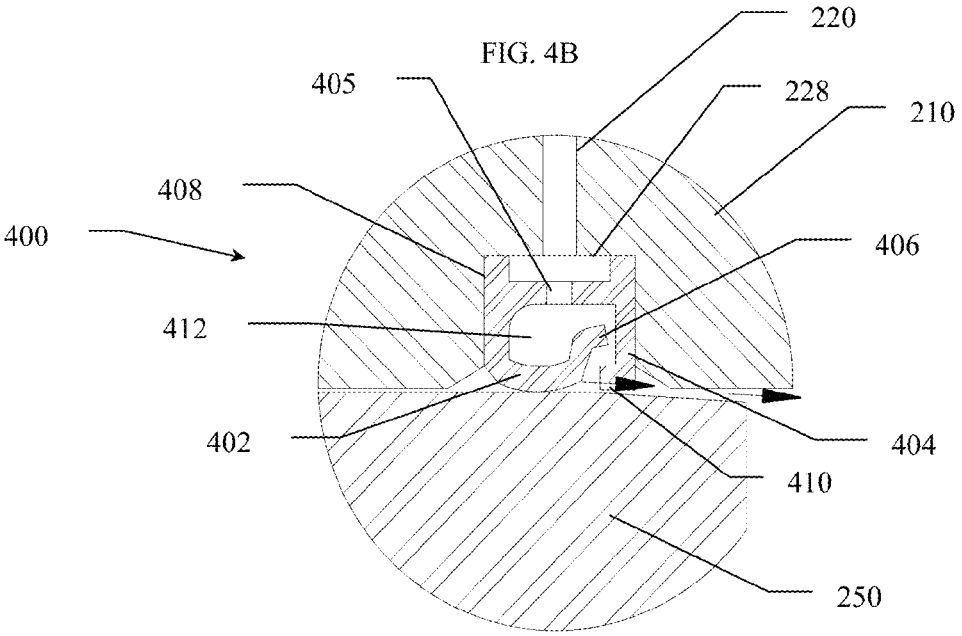

In an embodiment shown in FIG. 4A and FIG. 4B, the debris barrier 400 may comprise an element disposed in the groove 228 in the lower connection tool 204. In this embodiment, the debris barrier 400 comprises a spring element comprising a spring member 402 that can engage a latch member 404. The body element may comprise a debris barrier body 408 and a latch member 404. The debris barrier body 408 of the debris barrier may have a size and shape configured to be received within the groove 228. The spring member 402 comprises an extension of the debris barrier body 408 that has an end 406 that extends approximately across the width of the groove 228. The spring member 402 may extend in an arced, pointed, boxed, or other shape beyond the groove 228 and inner surface of the outer body 210. In this position, at least a portion of the spring member may extend into the flowbore 214 when the upper connection running tool 202 is not engaged with the lower connection tool 204. An optional latch member 404 comprises an extension of the debris barrier body 408 having an end 410 extending towards the spring member 402. The end 406 of the spring member 402 may engage the end 410 of the latch member 404 to thereby form a seal along the inner edge of the latch member 404. In an embodiment, the debris barrier 400 may not comprise a latch member 404. In this embodiment, the end 406 of the spring member 402 may contact the outer body 210 and may form a seal.

In some embodiments, the spring member 402 may not form a seal with the latch member 404, or in some embodiments, at the contact point with the outer body 210. Rather, the contact may prevent debris from entering the groove 228 while still maintaining fluid communication between the chamber 412 formed within the debris barrier 400 and the flowbore 214 when the upper connection running tool 202 is not engaged within the lower connection tool 204. This may allow for equalization of the fluid pressure in one or more fluid line across the debris barrier 400 to prevent pressure build up below the hydraulic connection mechanism 200. The debris barrier 400 may be constructed of any suitable material including, but not limited to, any elastomeric material, a polymer, a metal, any material capable of being elastically deformed, and any combination thereof.

As shown in FIG. 4B, the debris barrier 400 may be actuated to provide for fluid communication upon the engagement of the upper connection running tool 202 with the lower connection tool 204. As the inner body 250 is engaged within outer body 210, the outer surface of inner body 250 may contact the spring member 402, thereby displacing the spring member 402 outwards towards the groove 220 and fluid passageway 220. The mechanical actuation of the debris barrier 400 through the displacement of the debris barrier 400 upon contact with the inner body 250 may unseat the end 406 of the spring member 402 from the end 410 of the latch member 404. Upon engagement of the upper connection running tool 202 with the lower connection tool 204, a fluid communication pathway may be established from the upper connection running tool 202 through the channel 262 in the inner body 250, around the spring member 402, into the chamber 412 within the groove 228, through the openings 405, through the fluid passageway 220, through the port 218, and through the flow line disposed in the bypass slot 222. In an embodiment, a plurality of similar pathways may exist to provide fluid communication through the hydraulic connection mechanism 200 comprising the debris barrier 400. Upon disengagement of the upper connection running tool 202 from the lower connection tool 204, the spring member 202 may extend out of the groove 228 and contact the latch member 404 and/or the outer body 210, thereby establishing a barrier against debris entering the groove 228.

Upon actuation of the debris barrier 400, the resulting movement of the spring member 402 may displace a portion of the fluid within chamber 412, and cause the fluid to flow out of the chamber 412 and into flowbore 214. The displacement of the fluid due to the actuation of the debris barrier 400 may act to remove any debris from the groove 228 or the surface of the debris barrier 400. Further motion of the inner body 250 and any sealing elements 264 may push the fluid away from the groove 228 and remove any debris on the surface of the debris barrier 400 and/or the inner surface of the outer body 210.

Figure 5A:
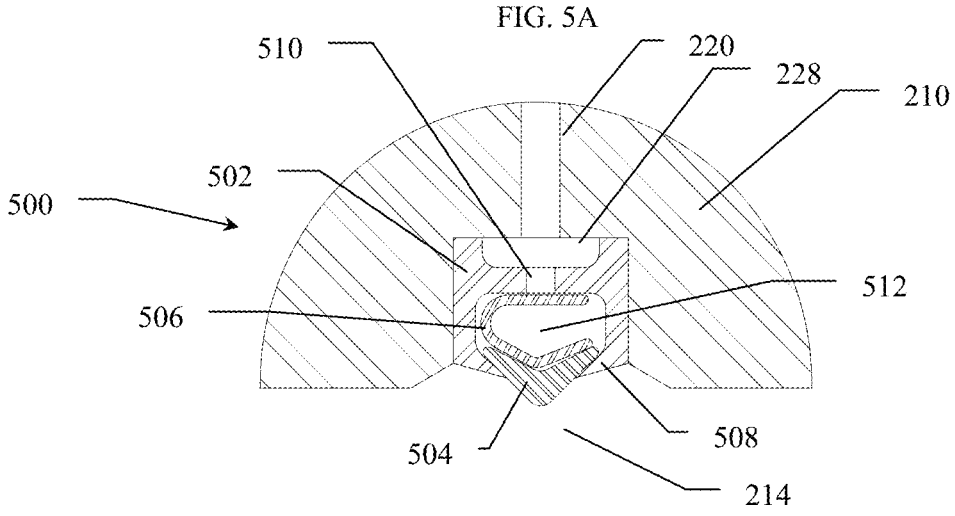
FIGS. 5A and 5B are cross-sectional views of a debris barrier according to another embodiment.
Figure 5B:
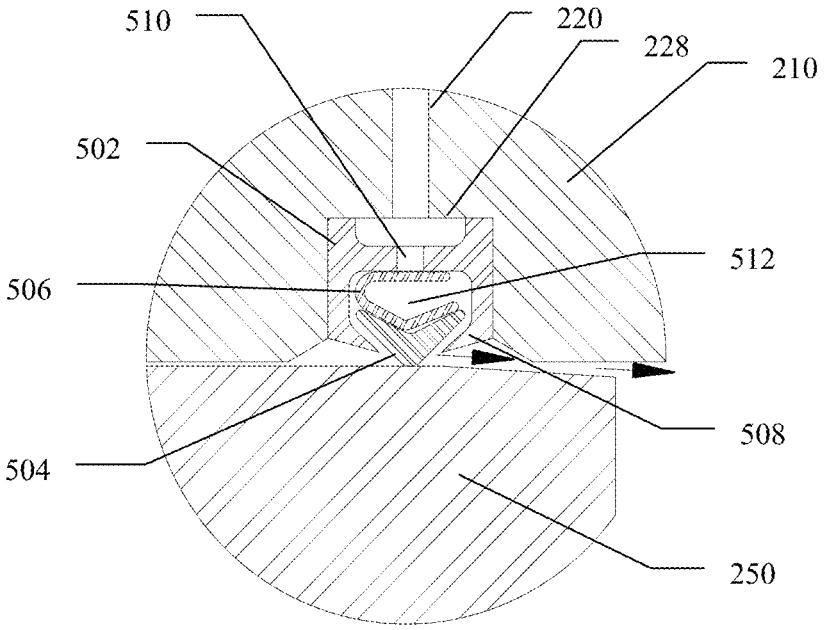

In another embodiment shown in FIG. 5A and FIG. 5B, the debris barrier 500 may comprise a spring loaded element disposed in the groove 228 in the lower connection tool 204. In this embodiment, the debris barrier 500 comprises a debris barrier body 502 with a body element comprising an inner member 504 engaging a spring element comprising a spring 506. The body 502 of the debris barrier may have a size and shape configured to be received within the groove 228. The body 502 comprises a seat 508 that is sized to be contained within the groove 228 and not extend beyond the inner surface of the outer body 210. One or more openings 510 may be formed within the body 502 of the debris barrier 500 to provide a fluid communication path between the cavity 512 formed within the debris barrier 500 and the fluid passageway 220. The spring 506 may be disposed within the body 502 and may bias the inner member 504 towards the seat 508. The spring 506 may comprise any type of spring known in the art. Since the debris barrier 500 may be disposed within the groove 228 around the inner perimeter of the outer body 210, the spring 506 may comprise a continuous spring extending around the perimeter, or a plurality of springs 506 may be used within the body 502. The inner member 504 is configured to engage the seat 508 to form a barrier against debris while having an inward extension that extends into the flowbore 214 beyond the inner surface of the outer body 210. The portion of the inner member 504 extending into the flowbore 214 may have a variety of shapes including triangular, round, oval, frusto-conical, or the like. In an embodiment, a seal is formed through the engagement of the inner member 504 with the seat 508.

In some embodiments, the inner member 504 may not form a seal with the seat 508. Rather, the contact between the inner member 504 and the seat 508 may prevent debris from entering the groove 228 while still maintaining fluid communication between the chamber 512 formed within the debris barrier 500 and the flowbore 214 when the upper connection running tool 202 is not engaged within the lower connection tool 204. This may allow for equalization of the fluid pressure in one or more fluid line across the debris barrier 500 to prevent pressure build up below the hydraulic connection mechanism 200. The body 502, the spring 506, and/or the inner member 504 of the debris barrier 500 may be constructed of any suitable materials including, but not limited to, any elastomeric material, a polymer, a metal, any other suitable material, and any combination thereof.

As shown in FIG. 5B, the debris barrier 500 may be actuated to provide for fluid communication upon the engagement of the upper connection running tool 202 with the lower connection tool 204. As the inner body 250 is engaged within outer body 210, the outer surface of inner body 250 may contact the inner member 504, thereby overcoming the bias of the spring 506 and displacing the inner member 504 outwards towards the groove 228. As the inner member 504 is displaced, the inner member 504 disengages from the seat 508 and provides a fluid communication pathway around the inner member 504 into the chamber 512. Upon engagement of the upper connection running tool 202 with the lower connection tool 204, a fluid communication pathway is established from the upper connection running tool 202 through the channel 262 in the inner body 250, around the inner member 504, into the chamber 512 within the groove 228, through the opening 510, through the fluid passageway 220, through the port 218, and through the flow line disposed in the bypass slot 222. In an embodiment, a plurality of similar fluid communication pathways may exist to provide fluid communication through the hydraulic connection mechanism 200 comprising the debris barrier 500. Upon disengagement of the upper connection running tool 202 from the lower connection tool 204, the spring 506 may bias the inner member 504 into contact with the seat 508, thereby establishing a barrier against debris entering the groove 228.

Upon actuation of the debris barrier 500, the resulting movement of the inner member 504 may displace a portion of the fluid within chamber 512, and cause the fluid to flow out of the chamber 512 and into flowbore 214. The displacement of the fluid due to the actuation of the debris barrier 500 may act to remove any debris from the groove 228 or the surface of the debris barrier 500. Further motion of the inner body 250 and any sealing elements 264 may push the fluid away from the groove 228 and remove any debris on the surface of the debris barrier 500 and/or the inner surface of the outer body 210.

Figure 6A:
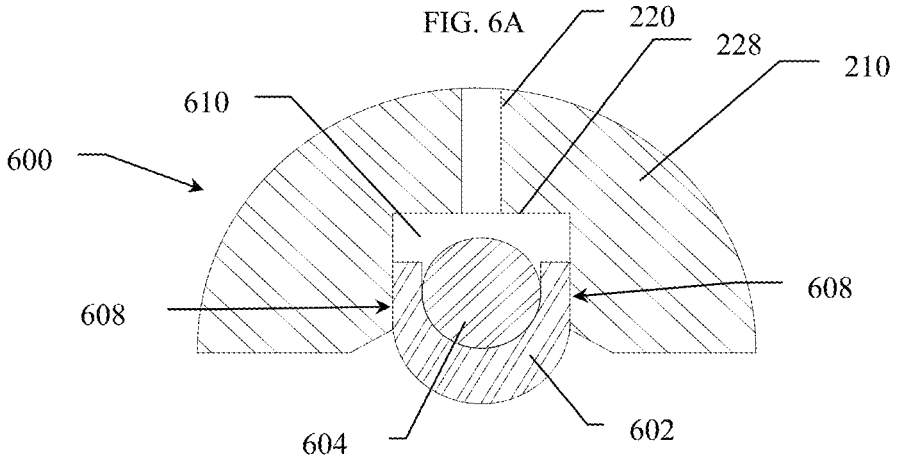
FIG. 6A-6D are cross-sectional views of a debris barrier according to still another embodiment.
Figure 6C:
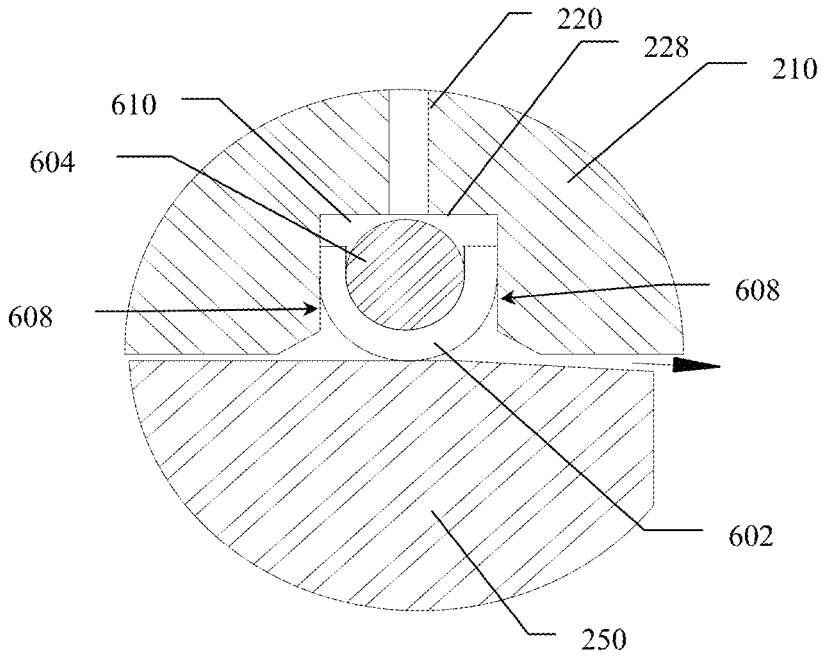
Figure 6B:
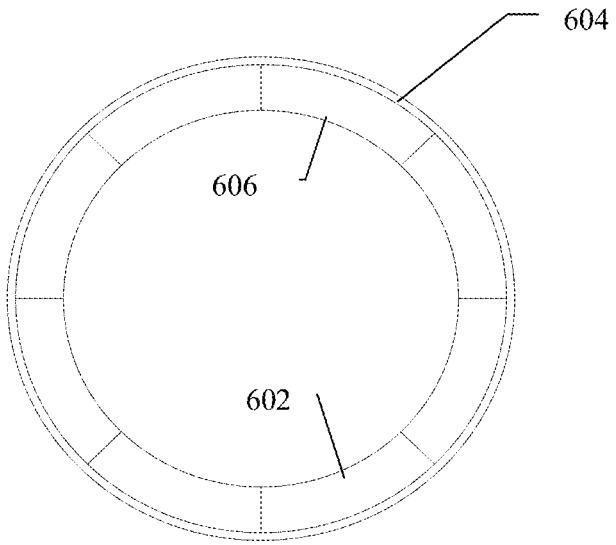

In still another embodiment shown in FIG. 6A and FIG. 6B, the debris barrier 600 may comprise a segmented ring disposed in the groove 228 in the lower connection tool 204. In this embodiment, the debris barrier 600 comprises a body element comprising a segmented debris barrier body 602 disposed in the groove 228 and retained by a spring element comprising a spring member 604. The body 602 of the debris barrier may have a size and shape configured to be received within the groove 228. The body 602 may have an inward extension that extends into the flowbore 214 beyond the inner surface of the outer body 210. While FIG. 6A illustrates a semi-circular cross-section, the body 602 may have any suitable shape such as a triangular, rectangular, elliptical, frustoconical, or the like. The body may engage the side walls 608 of the groove 228 to form a barrier against debris while being moveable with respect to the side walls 608. In an embodiment, a seal is formed through the engagement of the body 602 with the side walls 608 of the groove 228. As shown in FIG. 6B, the body 602 may comprise a plurality of body segments 606 arranged within the groove 228. In an embodiment, any number of segments may be employed to extend around the perimeter of the inner surface of the outer body 210 including, but not limited to about 2 to about 50 segments, alternatively about 4 to about 20 segments, or alternatively about 6 to about 10 segments. The segments may be aligned within the groove in an end-to-end fashion to form a ring along the inner circumference of the outer body 210 when the upper connection running tool 202 is not engaged within the lower connection tool 204.

A spring member 604 may be disposed within the groove 228 about the body 602 and may engage the body 602 to bias the body inward towards the flowbore 214. The spring member 604 may comprise any type of spring known in the art including a split-ring, an o-ring constructed of an elastic material, or the like. Since the body 602 and the spring member 604 may be disposed within the groove 228 around the inner circumference of the outer body 210, the spring member 604 may comprise a spring extending within the circumference of the groove 228, or alternatively, a plurality of spring members 604 may be used to bias the body 602 within the groove 228.

In some embodiments, the body 602 may not form a seal at the point of engagement with the side wall 608 of the outer body 210. Rather, the contact between the body 602 and the side wall 608 may prevent debris from entering the groove 228 while still maintaining fluid communication between the chamber 610 formed within the debris barrier 600 and the flowbore 214 when the upper connection running tool 202 is not engaged within the lower connection tool 204. This may allow for equalization of the fluid pressure in one or more fluid line across the debris barrier 600 to prevent pressure build up below the hydraulic connection mechanism 200. The body 602, and/or the spring member 604 of the debris barrier 600 may be constructed of any suitable materials including, but not limited to, any elastomeric material, a polymer, a metal, any other suitable material, and any combination thereof.

Figure 6D:
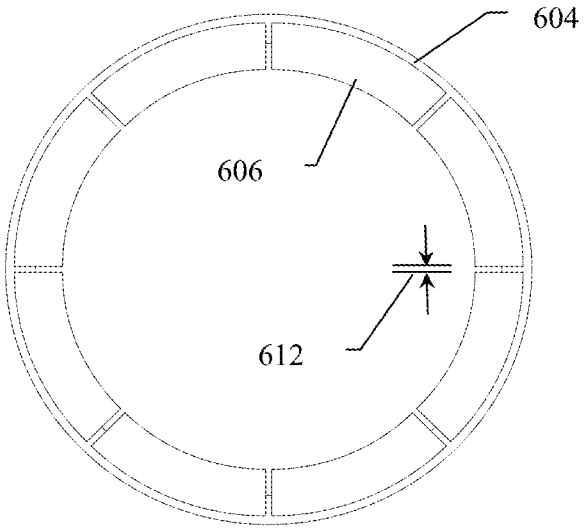

As shown in FIG. 6C and FIG. 6D, the debris barrier 600 may be actuated to provide fluid communication through the debris barrier 600 upon the engagement of the upper connection running tool 202 with the lower connection tool 204. As the inner body 250 is engaged within outer body 210, the outer surface of inner body 250 may contact the body 602, thereby overcoming the inward bias of the spring member 604 and displacing each segment 606 of the body 602 towards the groove 228. As each segment 606 is displaced outwards, a gap 612 may be formed between the ends of adjacent segments 606. Fluid from the flow passage 262 in the inner body 250 may travel along the inner edge of the body 602 until reaching the plurality of gaps 612, which may then provide a fluid communication pathway between the flow passage 262 in the inner body 250 and the chamber 610. Upon engagement of the upper connection running tool 202 with the lower connection tool 204, a fluid communication pathway is then established from the upper connection running tool 202 through the channel 262 in the inner body 250, through one or more gaps 612 between the segments 606, into the chamber 610 within the groove 228, through the fluid passageway 220, through the port 218, and through the flow line disposed in the bypass slot 222. In an embodiment, a plurality of similar fluid communication pathways may exist to provide fluid communication through the hydraulic connection mechanism 200 comprising the debris barrier 600. Upon disengagement of the upper connection running tool 202 from the lower connection tool 204, the spring member 604 may bias the segments 606 of the body 602 into contact with the walls 608 of the outer body 210, thereby establishing a barrier against debris entering the groove 228.

Upon actuation of the debris barrier 600, the resulting movement of the body 602 towards the groove 228 may displace a portion of the fluid within chamber 610 and cause the fluid to flow out of the chamber 610 and into flowbore 214. The displacement of the fluid due to the actuation of the debris barrier 600 may act to remove any debris from the groove 228 or the surface of the debris barrier 600. Further motion of the inner body 250 and any sealing elements 264 may push the fluid away from the groove 228 and remove any debris on the surface of the debris barrier 600 and/or the inner surface of the outer body 210.

In some embodiments, the outer body 210 may not comprise a groove 228 aligned with the fluid passageway 220. In these embodiments, the inner surface of the outer body 210 may comprise a generally smooth bore with one or more fluid passageways disposed along the inner surface. When the upper connection running tool 202 is not engaged within the lower connection tool 204, debris may deposit within the fluid passageways 220 resulting in the blockage of the fluid communication pathway through the hydraulic connection mechanism 200. In order to prevent debris from entering and potentially clogging a fluid passageway 220, a debris barrier may be disposed within the fluid passageway 220.

Figure 7B:
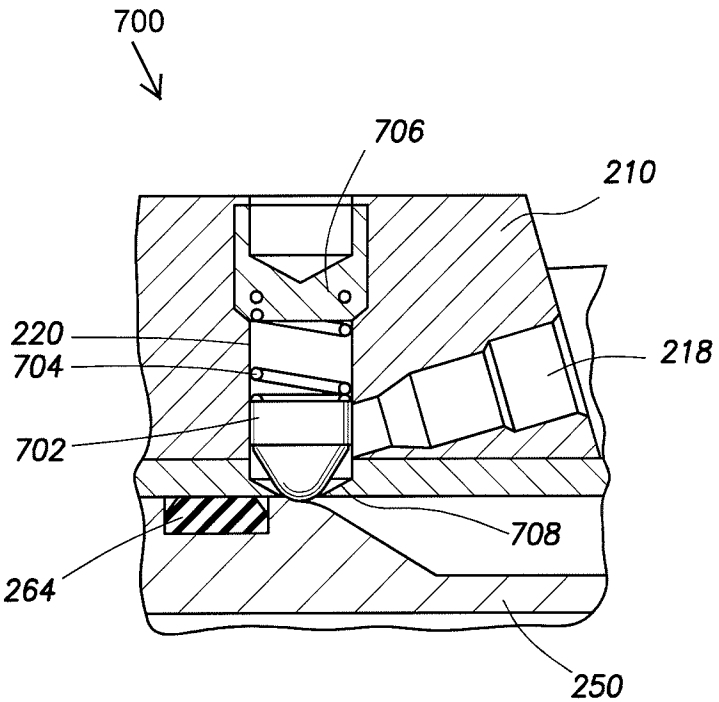
FIGS. 7A and 7B are cross-sectional views of a debris barrier according to yet another embodiment.
Figure 7A:
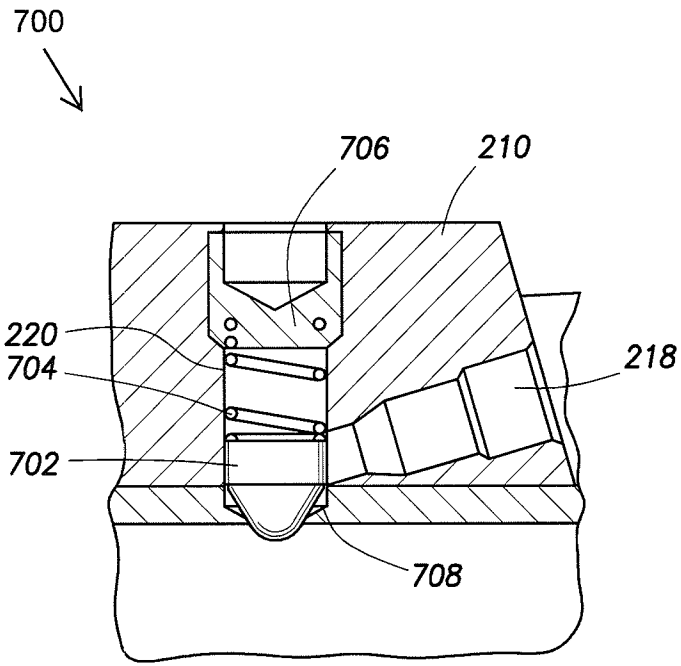

In an embodiment shown in FIG. 7A and FIG. 7B, the debris barrier 700 may comprise a spring loaded element disposed in the flow passage 220 in the outer body 210. This embodiment is similar to the embodiment discussed above with respect to FIG. 5A and FIG. 5B, except that the debris barrier 700 is disposed in the flow passage 220 rather than in the groove extending around the perimeter of the inner surface of the outer body 210. In this embodiment, the debris barrier 700 comprises a spring element comprising a spring 704 engaging a body element comprising a poppet 702. The spring 704 may be disposed within the flow passage 220 and bias the poppet 702 inward towards the flowbore 214 where the poppet 702 may engage a reduced diameter portion of the flowbore 220 that forms a seat 708. The spring 506 may comprise any type of spring known in the art. The poppet 702 may have a size and shape configured to be received within the flow passage 220 while having a portion extending beyond the seat 708 into the flowbore 214. The spring 704 may be disposed within the body 502 and may be retained in position by a retaining member 706. In an embodiment, the flow passage 220 may be formed in the outer body 210 and extend through the outer body 210. The retaining member 706 may be disposed within the flow passage 220 to retain the spring 704 and the poppet 702 within the flow passage 220 and may form a sealing engagement with the flow passage 220 to divert fluid through the port 218 rather than leaking outside the outer body 210. The poppet 702 is configured to engage the seat 708 to form a barrier against debris. In an embodiment, a seal is formed through the engagement of the poppet 702 with the seat 708. The poppet 702, the spring 704, and/or the retaining member 706 may be constructed of any suitable materials including, but not limited to, any elastomeric material, a polymer, a metal, or any combination thereof.

In some embodiments, the poppet 702 may not form a seal with the seat 708. Rather, the contact between the poppet 702 and the seat 708 may prevent debris from entering the flow passage 220 while still maintaining fluid communication between the port 218 and the flowbore 214 when the upper connection running tool 202 is not engaged within the lower connection tool 204. This may allow for equalization of the fluid pressure in one or more fluid line across the debris barrier 700 to prevent pressure build up below the hydraulic connection mechanism 200. While the embodiment of the debris barrier 700 has been described as being disposed in the lower connection tool 204 that does not comprise a groove 228, the debris barrier 700 may also be used in a flow passage 220 associated with an lower connection tool 204 having a groove 228 adjacent the flow passage 220.

As shown in FIG. 7B, the debris barrier 700 may be actuated to provide for fluid communication upon the engagement of the upper connection running tool 202 with the lower connection tool 204. As the inner body 250 is engaged within outer body 210, the outer surface of inner body 250 may contact the poppet 702, thereby overcoming the bias of the spring 704 and displacing the poppet 702 into the flow passage 220. As the poppet 702 is displaced, the poppet 702 disengages from the seat 708 and provides a fluid communication pathway around the poppet 702 into the flow passage 220. Upon engagement of the upper connection running tool 202 with the lower connection tool 204, a fluid communication pathway is established from the upper connection running tool 202, through the channel 262 in the inner body 250, through the annular gap formed between the inner body 250, the outer body 210, and the sealing elements 264, around the poppet 702, into the flow passage 220, through the port 218, and through the flow line disposed in the bypass slot 222. In an embodiment, a plurality of similar pathways may exist to provide fluid communication through the hydraulic connection mechanism 200 comprising the debris barrier 700. Upon disengagement of the upper connection running tool 202 from the lower connection tool 204, the spring 704 may bias the poppet 702 into contact with the seat 708, thereby establishing a barrier against debris entering the flow passage 220.

Upon actuation of the debris barrier 700, the resulting movement of the poppet 702 into the flow passage 220 may displace a portion of the fluid within flow passage 220 and/or the port 218, and cause the fluid to flow out of the flow passage 220 and into flowbore 214. The displacement of the fluid due to the actuation of the debris barrier 700 may act to remove any debris within the flow passage 220 and/or on the surface of the debris barrier 700. Further motion of the inner body 250 and any sealing elements 264 may push the fluid away from the flow passage 220 and remove any debris on the inner surface of the outer body 210.

Figure 8A:
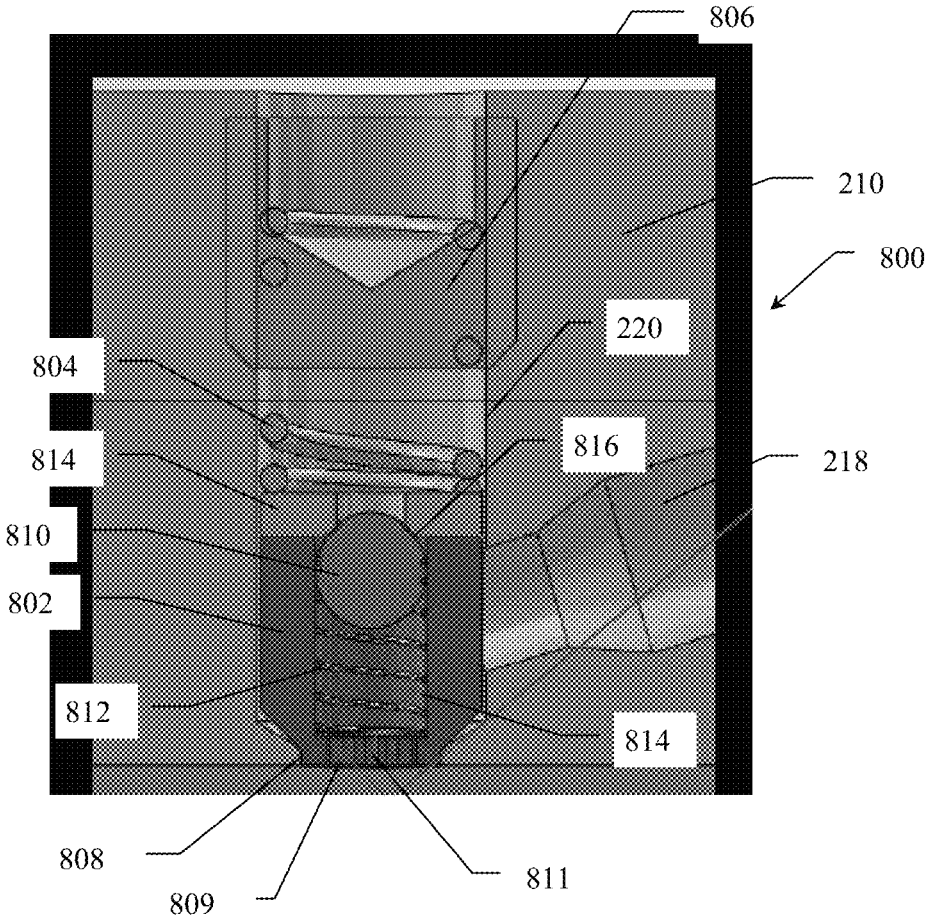
FIG. 8A-8C are cross-sectional views of a debris barrier according to still another embodiment.

In another embodiment shown in FIG. 8A, the debris barrier 800 may comprise a plurality of spring loaded elements in the flow passage 220 that are hydraulically actuated. This embodiment is similar to the embodiment discussed above with respect to FIG. 8A and FIG. 8B, except that the poppet 802 does not extend beyond the seat 808 in the flow passage 220, and the debris barrier 800 comprises a fluid valve disposed within the poppet 802. In this embodiment, the debris barrier 800 comprises a spring 804 engaging a poppet 802. The spring may be disposed within the flow passage 220 and bias the poppet 802 inward towards the flowbore 214 where the poppet 802 may engage a reduced diameter portion of the flowbore 220 that may form a seat 808. The spring 804 may comprise any type of suitable spring known in the art. The poppet 802 may have a size and shape configured to be received within the flow passage 220 and may have an end 809 that is flush, nearly flush, or recessed with respect to the inner surface of the outer body 210. The spring 804 may be disposed within the flow passage 220 and may be retained in position by a retaining member 806. In an embodiment, the flow passage 220 may be formed in the outer body 210 and extend through the outer body 210. The retaining member 806 may be disposed within the flow passage 220 to retain the spring 804 and the poppet 802 within the flow passage 220 and may form a sealing engagement with the flow passage 220 to divert fluid through the port 218 rather than leaking outside the outer body 210. The poppet 802 may be configured to engage the seat 808 to form a barrier against debris. In an embodiment, a seal is formed through the engagement of the poppet 802 with the seat 808. The poppet 802, the spring 804, and/or the retaining member 806 may be constructed of any suitable materials including, but not limited to, any elastomeric material, a polymer, a metal, any other suitable material, and any combination thereof.

The poppet 802 may comprise an inner fluid valve to provide for fluid communication from the flow passage 220 to the flowbore 214 upon the application of a pressure differential across the poppet 802. In an embodiment, the fluid valve may comprise an inner spring 812 engaging and biasing an inner body 810 towards an inner seat 814. The inner spring 812 may comprise any type of suitable spring known in the art. The inner body 810 may be generally spherical and may be disposed within a generally cylindrical pathway extending through the poppet 802. The pathway 814 may have a first portion having a cross-section configured to receive the inner body 810 and the inner spring 812. The first portion may extend from the end 809 of the poppet 802 to a transition point between the first portion and a second portion, which may form a shoulder 816. A second portion may have a reduced cross-section relative to the first portion and may retain the inner body 810 within the pathway 814. The shoulder 816 may server as a seat for the inner body 810, and in an embodiment, the inner body 810 may sealingly engage the shoulder 816. The end 809 may comprise a reduced cross-section with a shoulder formed at the transition between the cross-section of the pathway 814 and the reduced cross-section of the end 809. The shoulder may serve to retain the inner spring 812 within the pathway 814. The end 809 may be open to pathway 814 or may comprise a fluid permeable cover 811 such as a screen, grate, or filter to reduce the amount of debris that can enter the pathway 814. While the inner body 810 illustrated as a spherical element, any suitably shaped member capable of engaging the seat may be used. The inner body 810, the inner spring 812, and/or the cover 811 may be constructed of any suitable materials including, but not limited to, any elastomeric material, a polymer, a metal, any other suitable material, and any combination thereof.

Figure 8B:
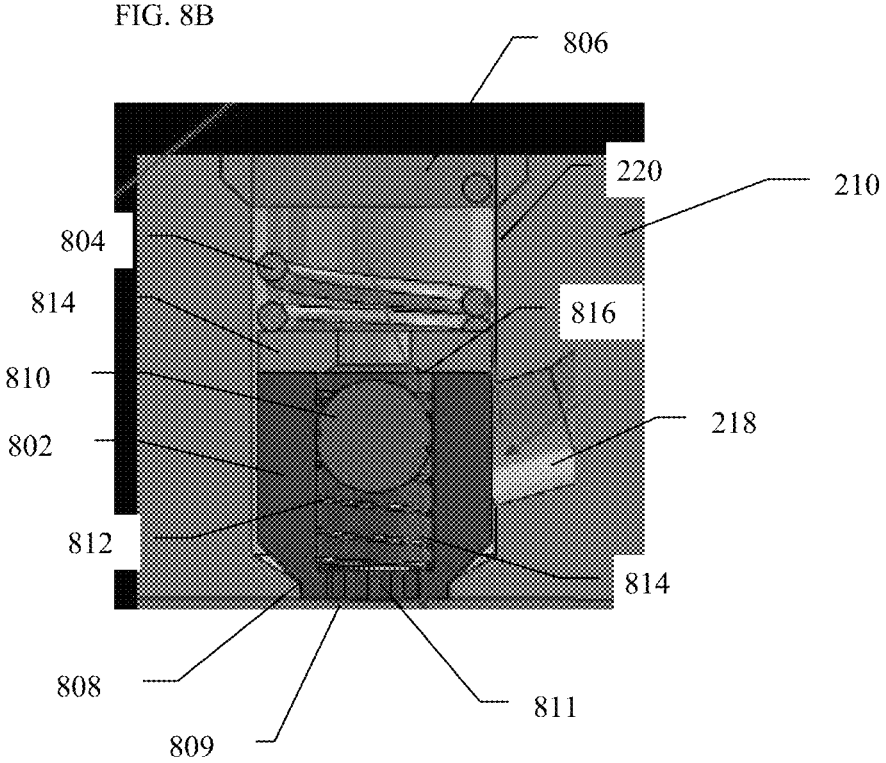

As shown in FIG. 8B, the debris barrier 800 may be hydraulically actuated to provide for fluid communication through the flow passage 220. Since the debris barrier 800 is not mechanically actuated through contact with the upper connection running tool 202, the fluid communication may occur with or without the upper connection running tool 202 engaged with the lower connection tool 204. When a fluid pressure develops within the port 218 that is greater than the fluid pressure within the flowbore 214, the fluid may flow through the port 218, around the poppet 802 to the flow passage 220 above the poppet 802. The pressure may then act on the inner body 810. Upon a sufficient pressure differential across the inner body 810, the force on the inner body 810 may overcome the bias of the inner spring 812 and displace the inner body 810 inwards towards the flowbore 214. As the inner body 810 is displaced from the seat formed at the shoulder 816, fluid may flow around the inner body 810, through the pathway 814, through the cover 811, and into the flowbore 214. The pressure within the flow passage 220 may further bias the poppet 802 into contact with the seat 808 to prevent the flow of fluid around the poppet 802. When the upper connection running tool 202 is engaged within the lower connection tool 204, a fluid communication pathway may be established from below the hydraulic connection mechanism 200 to above the hydraulic connection mechanism 200 through the flow line disposed in the bypass slot 222, through the port 218, around the poppet 802, into the flow passage 220, around the inner body 810, through the pathway 814, through the cover 811, through the annular gap formed between the inner body 250, the outer body 210, and the corresponding sealing elements 264, through the channel 262 in the inner body 250, through fluid passageway 260, through port 258, and through the flow line disposed in the recess 266. In an embodiment, a plurality of similar fluid communication pathways may exist to provide fluid communication from below the hydraulic connection mechanism 200 to above the hydraulic connection mechanism 200 through the debris barrier 800.

Figure 8C:
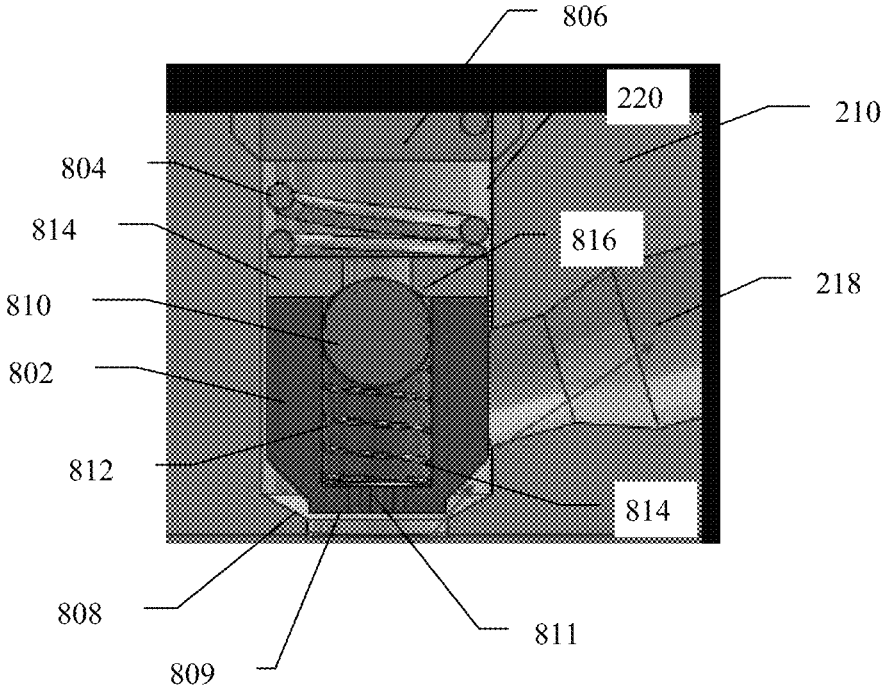
Figure 1:
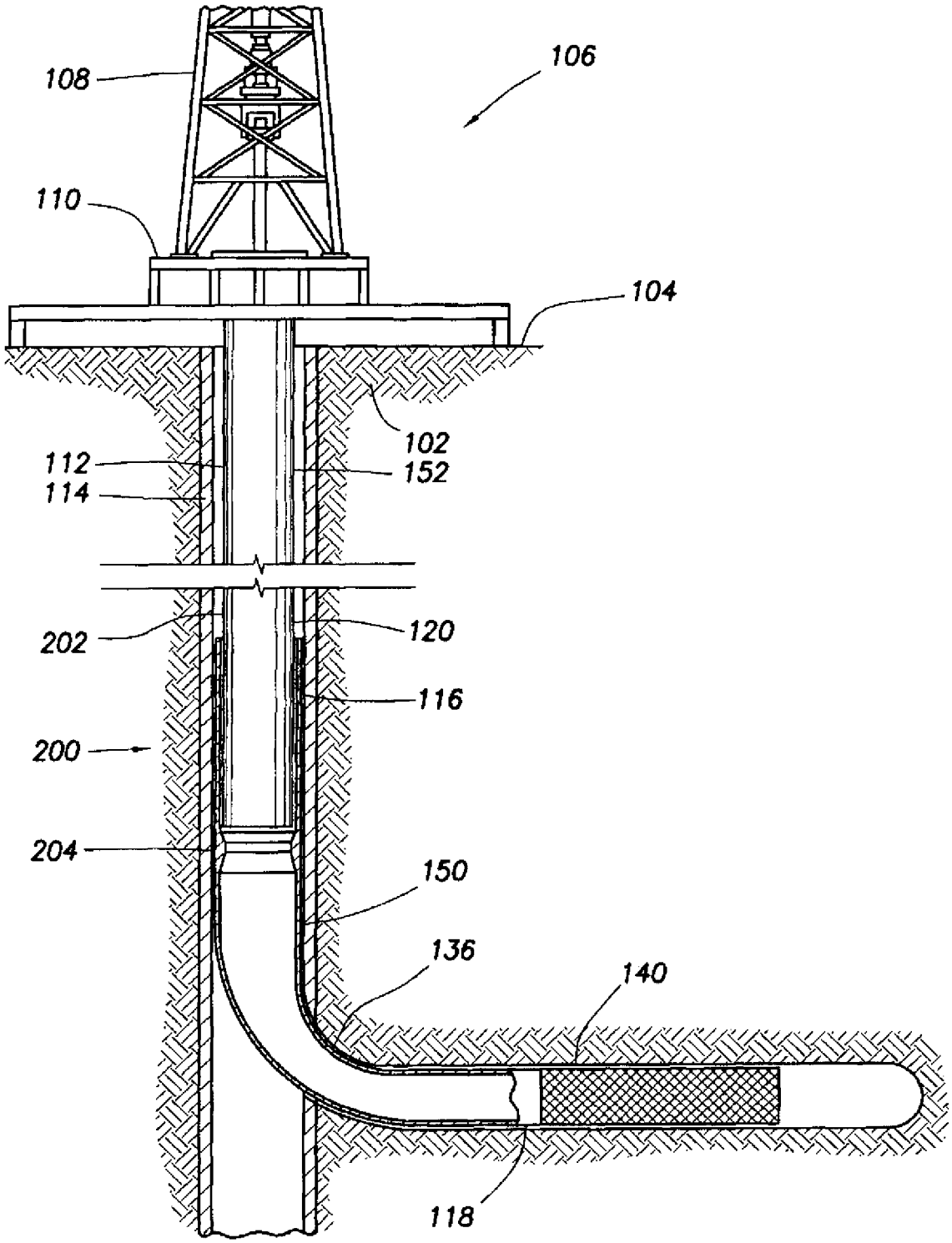
Figure 2:
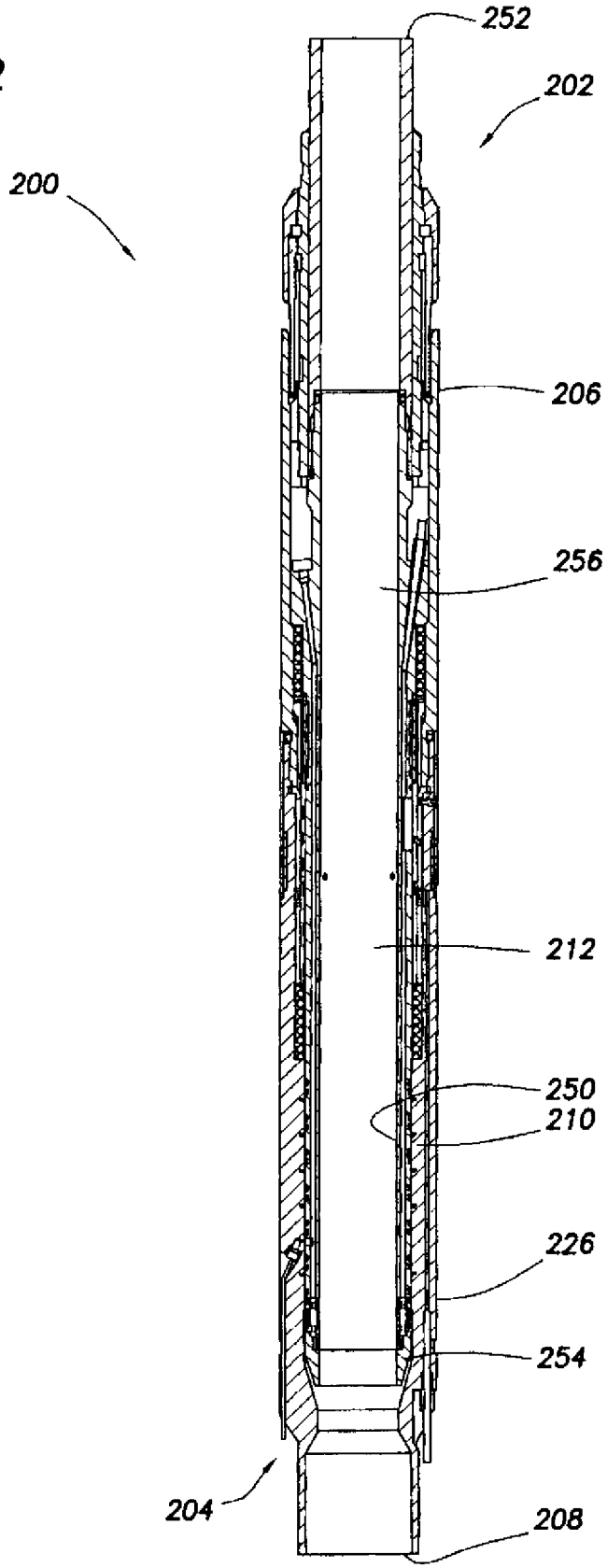
Figure 3:
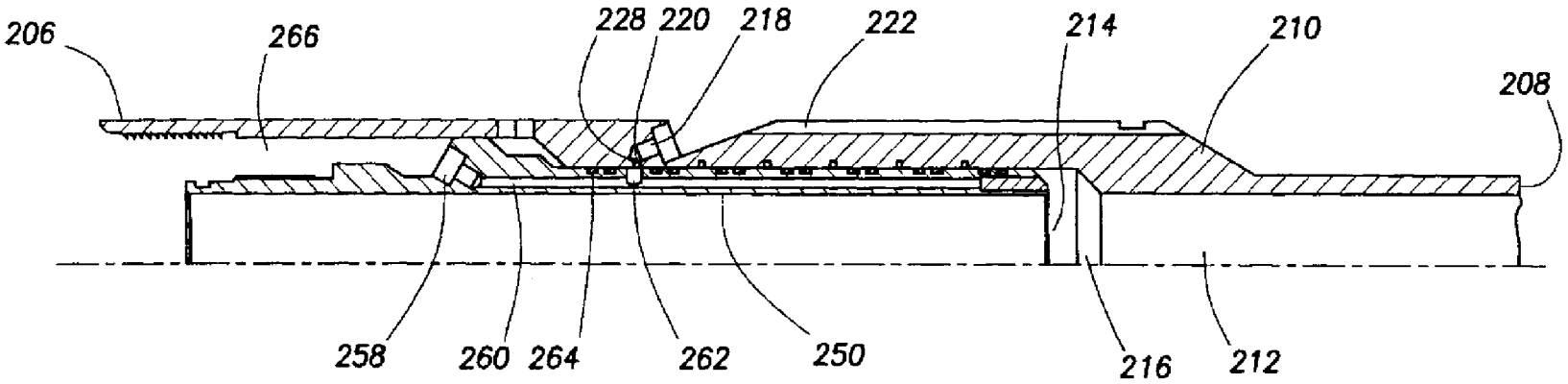
Figure 4A:
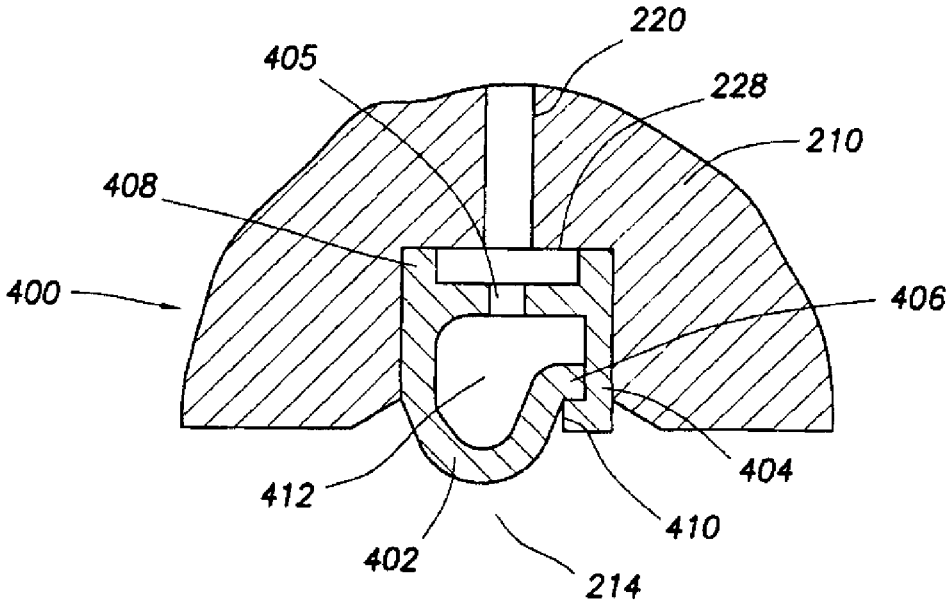
Figure 4B:
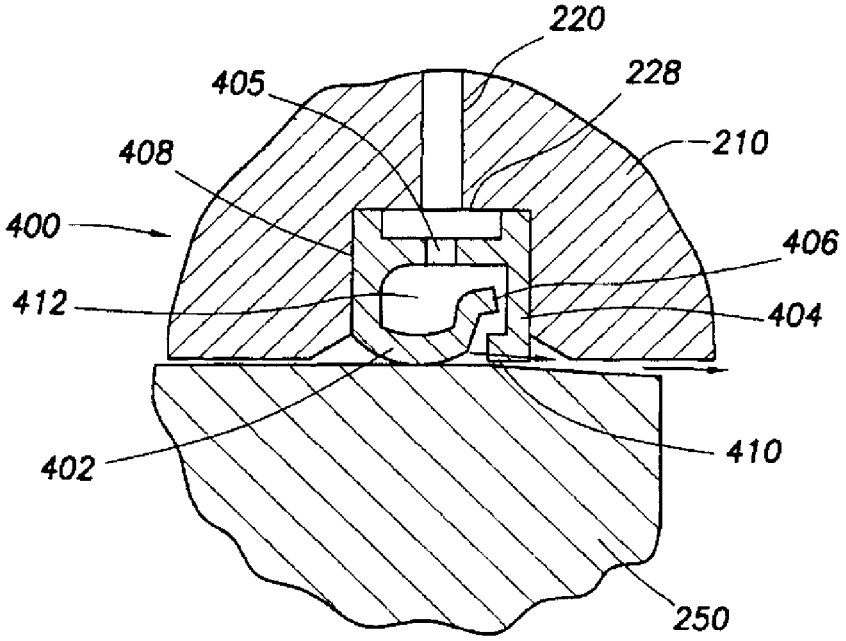
Figure 5A:
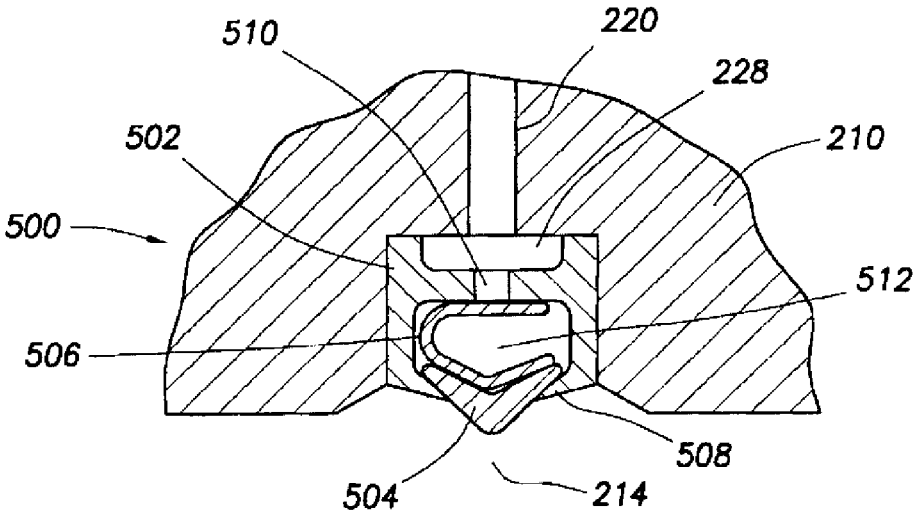
Figure 5B:
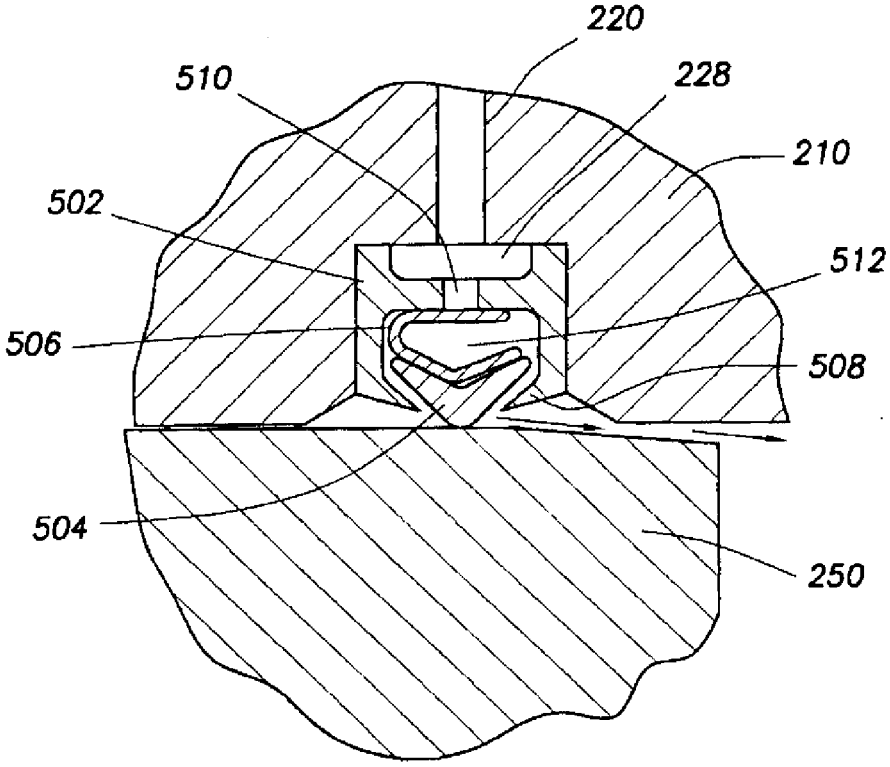
Figure 6A:
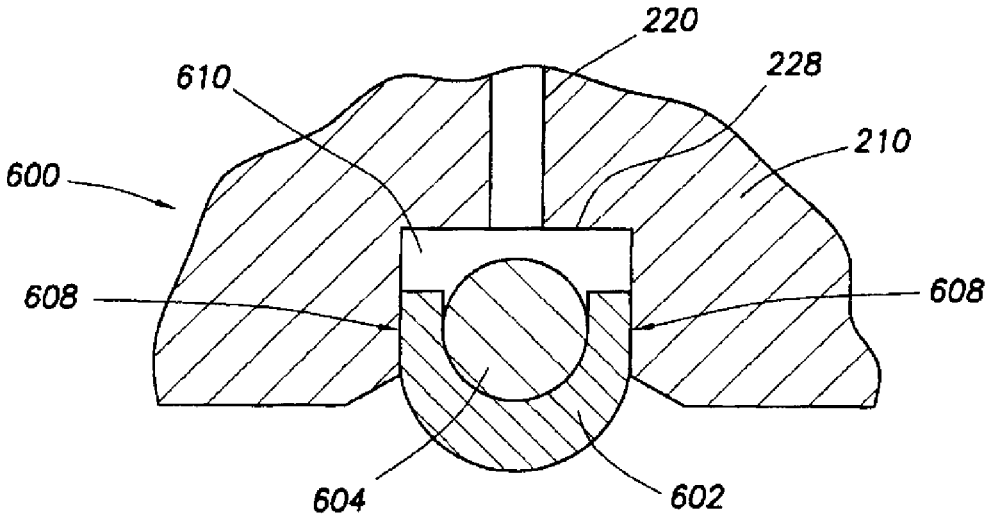
Figure 6C:
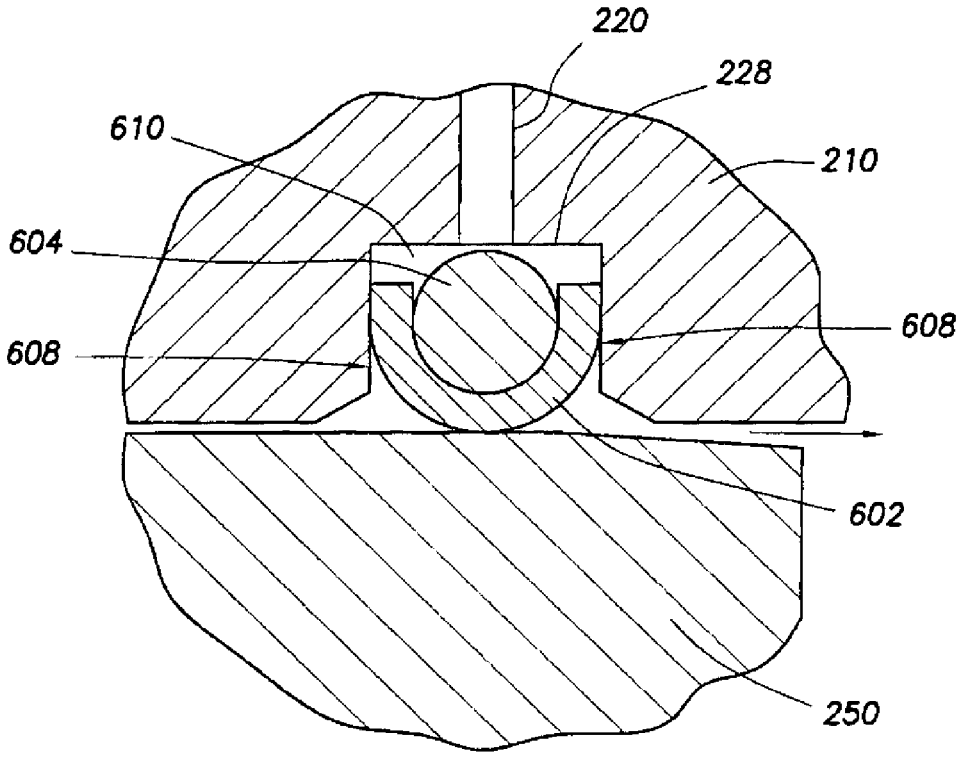
Figure 6B:
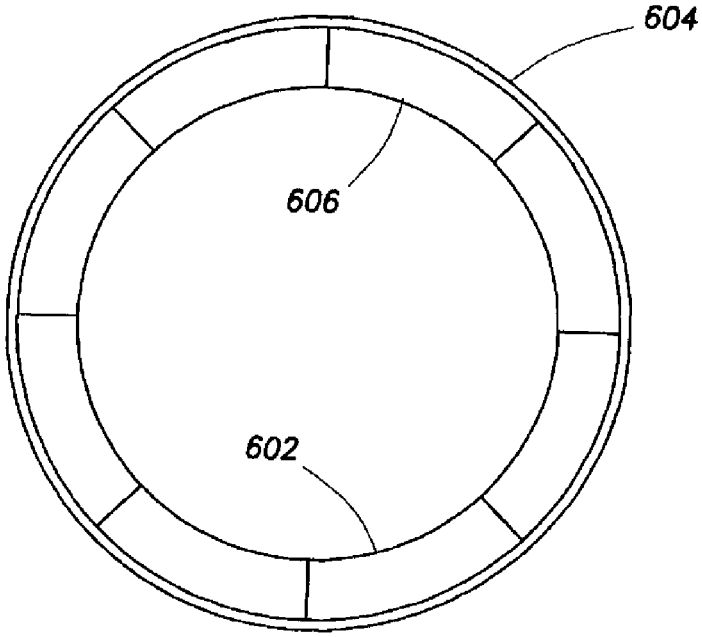
Figure 6D:
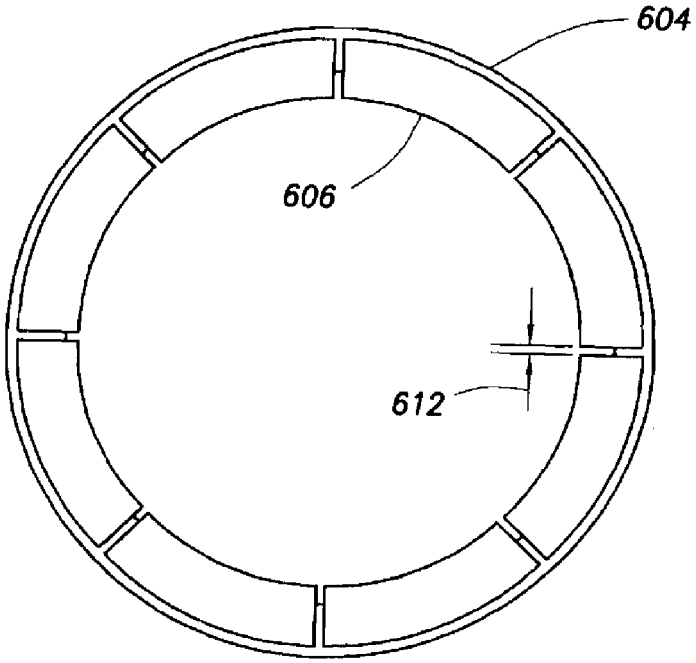
Figure 8A:
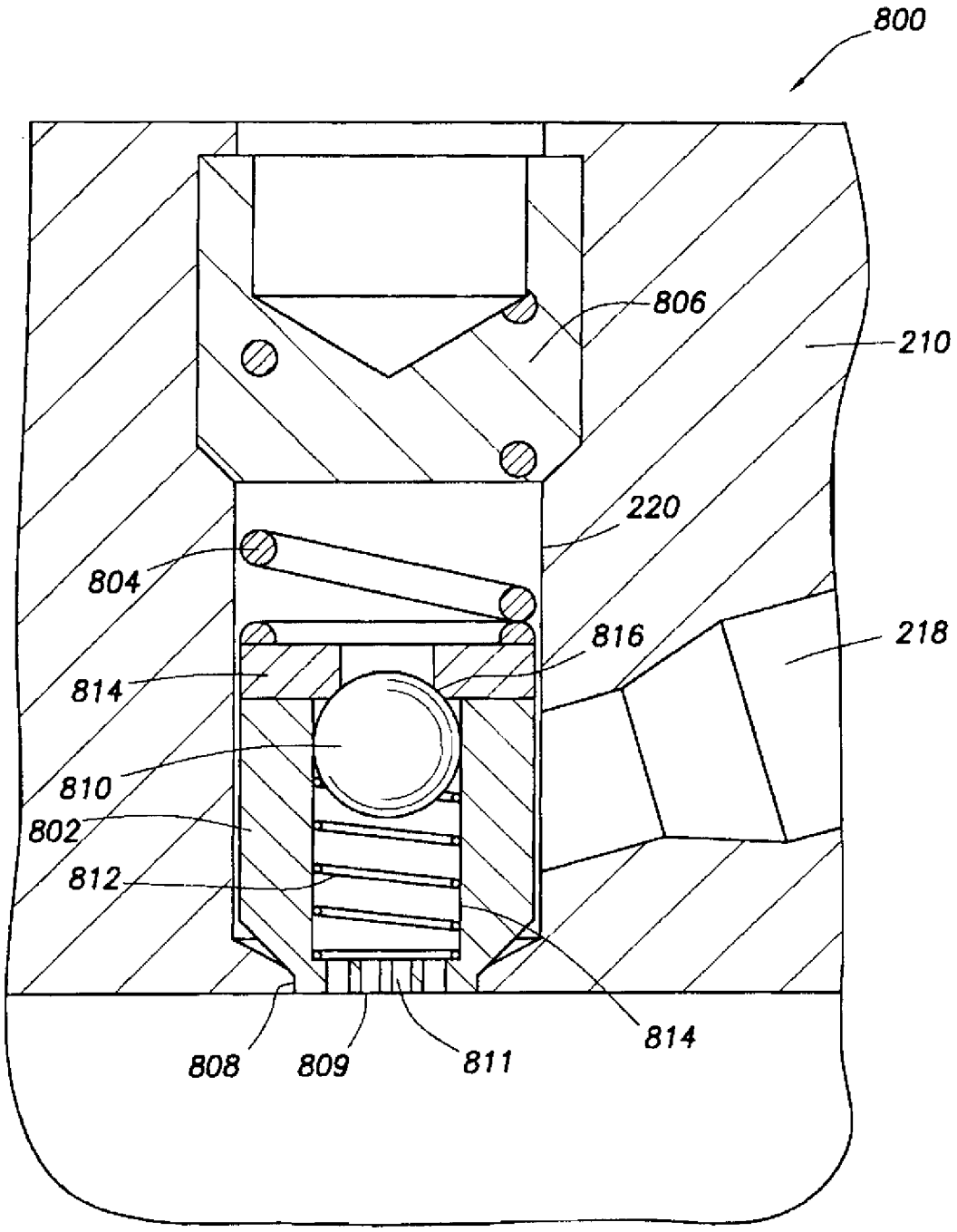
Figure 8C:
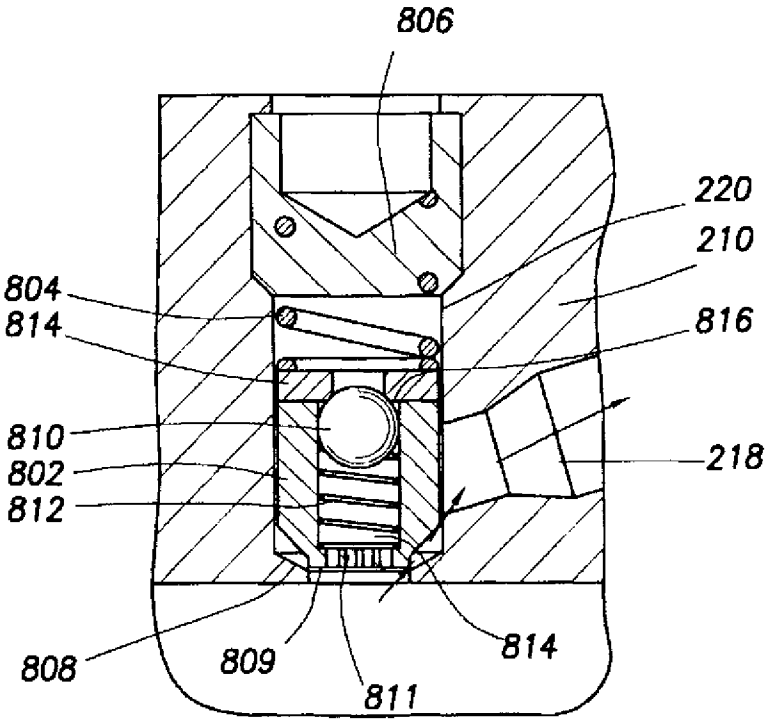
Figure 8B:
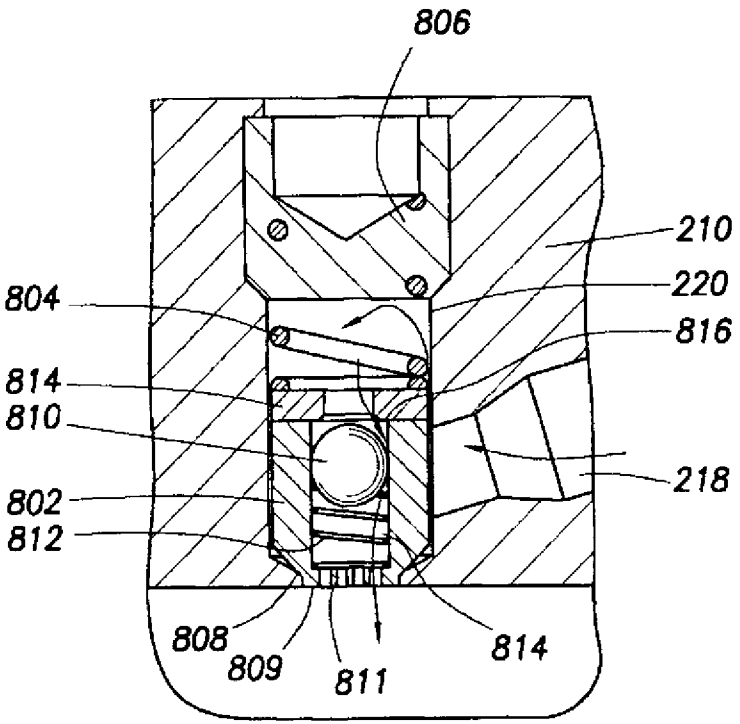

As shown in FIG. 8C, when a fluid pressure develops within the port 218 that is less than the fluid pressure within the flowbore 214, the pressure differential may act upon the end 809 of the poppet 802 relative to the reduced pressure within the flow passage 220, which is in fluid communication with the fluid in the port 218 and therefore at the same pressure. Upon a sufficient pressure differential across the poppet 802, the force on the poppet 802 may overcome the bias of the spring 804 and displace the poppet 802 outwards into the flowbore 214. As the poppet 802 is displaced from the seat 808, fluid may flow around the poppet 802, through the flow passage 220, and into the port 218. The pressure within the flowbore 214 may act upon the inward surface of the inner body 810 and further bias the inner body 810 into contact with the seat at the shoulder 816 to prevent the flow of fluid around the inner body 810. When the upper connection running tool 202 is engaged within the lower connection tool 204, a fluid communication pathway may be established from above the hydraulic connection mechanism 200 to below the hydraulic connection mechanism 200 through the flow line disposed in the recess 266, through port 258, through fluid passageway 260, through the channel 262 in the inner body 250, through the annular gap formed between the inner body 250, the outer body 210, and the corresponding sealing elements 264, around the poppet 802, into the flow passage 220, through the port 218, and through the flow line disposed in the bypass slot 222. In an embodiment, a plurality of similar fluid communication pathways may exist to provide fluid communication from above the hydraulic connection mechanism 200 to below the hydraulic connection mechanism 200 through the debris barrier 800. Upon disengagement of the upper connection running tool 202 from the lower connection tool 204, the spring 804 may bias the poppet 802 into contact with the seat 808, thereby establishing a barrier against debris entering the flow passage 220.

The debris barrier 800 may not displace any fluid upon actuation since the debris barrier 800 is hydraulically actuated based on a pressure differential across the debris barrier 800 in either direction. The configuration of debris barrier 800 without the poppet 802 extending into the flowbore 214, may provide a flush or nearly flush configuration of the poppet 802 in the flow passage 220. During the coupling of the upper connection running tool 202 and the lower connection tool 204, the resulting movement the inner body 250 and any sealing elements 264 may remove any debris on the end 809 of the poppet 802 and/or the inner surface of the outer body 210.

In an embodiment, the hydraulic connection mechanism 200 may comprise any combination of debris barriers. When a plurality of fluid communication pathways exist through the hydraulic connection mechanism 200, some of the fluid communication pathways may comprise a groove 228 with a debris barrier disposed within the groove, and some of the fluid communication pathways may not comprise a groove 288 and rather may comprise a debris barrier disposed within the flow passageway 220. In some embodiments in which one or more of the fluid communication pathways comprise a groove 228, a debris barrier may be disposed within the groove and/or the flow passageway 220 in communication with the groove 228. For example, a debris barrier such as shown in FIG. 4A may be disposed in a groove 228 and a debris barrier such as shown in FIG. 8A may be disposed within the flow passageway 220 in fluid communication with the groove 228. Using a plurality of debris barriers may reduce the amount of debris within one or more fluid communication pathway.

The hydraulic connection mechanism comprising one or more debris barriers may be used in a variety of servicing and treatment procedures throughout the life of a wellbore. Referring to FIG. 1-3, a wellbore tubular string 120 comprising a hydraulic connection mechanism 200 may be disposed within the wellbore 114. One or more fluid communication pathways may be used to operate a variety of tools or mechanisms in the wellbore 114 with fluid provided through the hydraulic connection mechanism. Tools capable of being operated with fluid include, by way of example only, safety valves, tools comprising sliding sleeves, tools comprising cylinders or pistons, tools using control line signals, and the like. When it is desired to remove a portion of the wellbore tubular string 120 above the hydraulic connection mechanism 200 such as the upper wellbore tubular section 152, the upper connection running tool 202 may be disengaged from the lower connection tool 204. The upper connection running tool 202 may be disengaged from the lower connection tool 204 using any known engagement/disengagement connection actions such as snap-in/snap-out connections, snap-in/rotate-out connections, and/or snap-in/shear-to-release connections. The debris barrier within the lower connection tool 204 may then be mechanically or hydraulically actuated to prevent any debris from entering fluid communication pathway such as a groove 228 and/or a flow passage 220 within the outer body 210 of the lower connection tool 204. Upon redeploying the wellbore tubular comprising the upper connection running tool 202, the lower connection tool 204 may receive the upper connection running tool 202. The one or more debris barriers may be mechanically or hydraulically actuated to re-establish a fluid communication pathway through the debris barrier to provide one or more fluid communication pathways through the hydraulic connection mechanism 200. Upon re-engagement of the upper connection running tool 202 within the lower connection tool 204 fluid within the groove 228 and/or the flow passage 220, a portion of a fluid in the fluid communication pathway may be displaced into the flowbore 214, thereby removing at least a portion of any debris within and/or on the surface of the debris barrier and/or the inner surface of the outer body 210 of the lower connection tool 204.

As an example of a method using the hydraulic connection mechanism 200 comprising a debris barrier, a completion assembly may be disposed within the wellbore 114 that comprises a hydraulic connection mechanism 200. A completion assembly and a safety shutoff valve may be disposed within the lower wellbore tubular section 150 and an electric submersible pump ("ESP") may be disposed in the upper wellbore tubular section 152 above the hydraulic connection mechanism 200. As an example of a servicing procedure, the ESP may be replaced and/or repaired. In order to remove the upper wellbore tubular section 152 from the wellbore 114, the safety shutoff valve may first be actuated to a closed position by using a hydraulic fluid provided through a fluid communication pathway passing through the hydraulic connection mechanism 200 as described above. Once the safety shutoff valve is in the closed position, the upper wellbore tubular section 152 may be removed from the wellbore 114 by disengaging the upper connection running tool 202 from the lower connection tool 204. The debris barrier within the lower connection tool 204 may then be mechanically or hydraulically actuated to prevent any debris from entering a groove 228 or a flow passage 220 within the outer body 210 of the lower connection tool 204. The upper wellbore tubular section 152 may then be removed from the wellbore 114 and the ESP may be replaced and/or repaired using known methods.

Once the ESP has been replaced and/or repaired, the upper wellbore tubular section 152 comprising the upper connection running tool 202 may be re-deployed within the wellbore 114. Upon redeploying the wellbore tubular comprising the upper connection running tool 202, the lower connection tool 204 may receive the upper connection running tool 202. The one or more debris barriers may be mechanically or hydraulically actuated to re-establish a fluid communication pathway through the debris barrier to provide one or more fluid communication pathways through the hydraulic connection mechanism 200. Upon re-engagement of the upper connection running tool 202 within the lower connection tool 204 fluid within the groove 228 and/or the flow passage 220, a portion of a fluid in the fluid communication pathway may be displaced into the flowbore 214, thereby removing at least a portion of any debris within and/or on the surface of the debris barrier and/or the inner surface of the outer body 210 of the lower connection tool 204. Once the fluid communication pathway has been re-established through the hydraulic connection mechanism 200, the safety shutoff valve may be hydraulically actuated to an open position. The new and/or repaired ESP may then be actuated to resume production of a fluid from the wellbore 114.

It will be appreciated from the above method and example, that the hydraulic connection mechanism 200 may allow a portion of the wellbore tubular string to be removed and/or replaced within a wellbore without removing the entire wellbore tubular string. Further, the ability to actuate one or more tools below the hydraulic connection mechanism may allow the completion assembly and safety equipment to be maintained within the wellbore when an upper wellbore tubular section is removed and replaced. Further, one or more debris barriers within the hydraulic connection mechanism may help reduce or prevent debris from entering the fluid communication pathways while the upper connection running tool is disengaged from the lower connection tool 204. Upon engagement of the upper connection running tool from the lower connection tool 204, fluid may be displaced into the flowbore to purge the debris barrier and/or the lower connection tool 204 of debris that may have deposited while the hydraulic connection mechanism was not engaged with the lower connection tool 204.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A hydraulic connection mechanism for use in a wellbore comprising:

an upper connection tool comprising a first flow line;

a lower connection tool comprising a second flow line and a circumferential groove, wherein the second flow line is in fluid communication with the circumferential groove, and wherein the lower connection tool is configured to releasably engage the upper connection tool and form a fluid communication pathway through the hydraulic connection mechanism between the first flow line and the second flow line through the circumferential groove; and a debris barrier disposed at least partially within the circumferential groove in the fluid communication pathway, wherein the debris barrier comprises:

a body element; and a spring element configured to maintain the body element in a closed position when the upper connection tool is disengaged from the lower connection tool.

2. The hydraulic connection mechanism of claim 1, wherein the body element comprises a debris barrier body and a latch member disposed within a groove within the lower connection tool; and wherein the spring element comprises a spring member comprising an extension of the debris barrier body that is configured to extend inward beyond an inner surface of the lower connection tool when the upper connection tool is disengaged from the lower connection tool.

3. The hydraulic connection mechanism of claim 2, wherein the extension is configured to engage the latch member in the closed position.

4. The hydraulic connection mechanism of claim 1, wherein the lower connection tool further comprises a debris barrier body comprising a seat;

wherein the body element comprises an inner member disposed within the circumferential groove within the lower connection tool;

wherein a portion of the inner member extends inward beyond an inner surface of the lower connection tool when the upper connection tool is disengaged from the lower connection tool; and wherein the spring element comprises a spring disposed within the lower connection tool that engages the inner member.

5. The hydraulic connection mechanism of claim 4, wherein the spring is configured to bias the inner member into contact with the seat in the closed position.

6. The hydraulic connection mechanism of claim 1, wherein the body element comprises a segmented debris barrier body comprising a plurality of body segments and disposed within a groove within the lower connection tool;

wherein a portion of the segmented debris barrier body is configured to extend inward beyond an inner surface of the lower connection tool when the upper connection tool is disengaged from the lower connection tool; and wherein the spring element comprises a spring element disposed within the lower connection tool that engages the segmented debris barrier body.

7. The hydraulic connection mechanism of claim 6, wherein the spring element is configured to bias the plurality of body segments into an end-to-end configuration around an inner surface of the lower connection tool in the closed position.

8. The hydraulic connection mechanism of claim 1, wherein the upper connection tool is configured to be removed from the lower connection tool.

9. The hydraulic connection mechanism of claim 1, wherein the body element is configured to maintain fluid communication through the debris barrier in the closed position.

10. A method of servicing a wellbore comprising:

providing a hydraulic connection mechanism within a wellbore, wherein the hydraulic connection mechanism comprises:

an upper connection tool;

a lower connection tool comprising a circumferential groove, wherein the lower connection tool releasably engages the upper connection tool, wherein a fluid communication pathway is formed through the circumferential groove in the hydraulic connection mechanism when the upper connection tool engages the lower connection tool; and a debris barrier disposed at least partially within the circumferential groove in the fluid communication pathway;

disengaging the upper connection tool from the lower connection tool;

allowing the debris barrier to close off the fluid communication pathway;

re-engaging the upper connection tool with the lower connection tool; and actuating the debris barrier to establish fluid communication through the fluid communication pathway.

11. The method of claim 10, wherein the debris barrier is mechanically actuated by an engagement with the upper connection tool.

12. The method of claim 10, further comprising a plurality of fluid communication pathways formed by the engagement of the upper connection tool and the lower connection tool, wherein each debris barrier of a plurality of debris barriers is disposed in each of the plurality of fluid communication pathways, wherein each debris barrier is allowed to close off the corresponding fluid communication pathway; and wherein each debris barrier is actuated to establish fluid communication through the corresponding fluid communication pathway.

13. The method of claim 10, further comprising providing a control signal from above the upper connection tool to a component below the lower connection tool through the fluid communication pathway comprising the debris barrier.

14. The method of claim 10, wherein disengaging the upper connection tool from the lower connection tool comprises removing the upper connection tool from the lower connection tool.

15. The method of claim 10, further comprising removing at least a portion of any debris on a surface of the debris barrier in response to re-engaging the upper connection tool with the lower connection tool.

16. A method of actuating a debris barrier comprising:

providing a debris barrier disposed in a fluid communication pathway within a lower connection tool within a wellbore, wherein the debris barrier is at least partially disposed within a circumferential groove in the lower connection tool;

engaging an upper connection tool with the lower connection tool;

actuating the debris barrier to displace a portion of a fluid in the fluid communication pathway; and establishing fluid communication between the upper connection tool and the lower connection tool through the circumferential groove in the fluid communication pathway comprising the debris barrier.

17. The method of claim 16, wherein the circumferential groove is disposed on an inner surface of the lower connection tool.

18. The method of claim 16, wherein the debris barrier forms a seal in the fluid communication pathway when the upper connection tool is disengaged from the lower connection tool.

19. The method of claim 16, further comprising removing at least a portion of any debris on a surface of the debris barrier in response to engaging the upper connection tool with the lower connection tool.

* * * * *

UNITED STATES PATENT AND TRADEMARK OFFICE

CERTIFICATE OF CORRECTION

PATENT NO. : 8,739,885 B2
APPLICATION NO. : 13/210019
DATED : June 3, 2014
INVENTOR(S) : Joel D. Shaw et al.

It is certified that error appears in the above-identified patent and that said Letters Patent is hereby corrected as shown below:

Delete the title page showing an illustrative figure, and substitute the attached title page therefor.

In the Drawings

Delete drawing sheets 1-7 and drawing sheets 9-10, and substitute the attached drawing sheets 1-7 and 9-10 therefor.

Signed and Sealed this
Twelfth Day of August, 2014

Michelle K. Lee

Michelle K. Lee
*Deputy Director of the United States Patent and Trademark Office*

(12) United States Patent
Shaw et al.

(10) Patent No.: US 8,739,885 B2
(45) Date of Patent: Jun. 3, 2014

(54) DEBRIS BARRIER FOR HYDRAULIC DISCONNECT TOOLS

(75) Inventors: Joel D. Shaw, Houston, TX (US); Greg Marshall, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 13/210,019

(22) Filed: Aug. 15, 2011

(65) Prior Publication Data

US 2013/0043038 A1 Feb. 21, 2013

(51) Int. Cl.
*E21B 34/06* (2006.01)
*E21B 34/00* (2006.01)
*E21B 17/00* (2006.01)

(52) U.S. Cl.
USPC ..... 166/373; 166/325; 166/242.6

(58) Field of Classification Search
USPC ..... 166/242.6, 325, 332.5, 373, 326
See application file for complete search history.

(56) References Cited

U.S. PATENT DOCUMENTS 2,277,380 A * 3/1942 Yancey ..... 166/74
3,216,466 A * 11/1965 Simko ..... 141/226
3,433,455 A 3/1969 Cook
4,460,156 A * 7/1984 Hazelrigg et al. ..... 251/149.3
6,408,946 B1 6/2002 Marshall et al.
7,373,974 B2 5/2008 Connell et al.
7,640,977 B2 1/2010 Jonas
7,798,212 B2 9/2010 Bolze et al.
2011/0108266 A1 5/2011 Smith et al.
2012/0012327 A1 * 1/2012 Plunkett et al. ..... 166/324

OTHER PUBLICATIONS

Filing receipt and specification for patent application entitled "Debris Barrier for Hydraulic Disconnect Tools," by Joel D. Shaw, et al., filed Oct. 2, 2012 as U.S. Appl. No. 13/633,736.
WellDynamics brochure H06979 entitled, "Concentric Electric Disconnect—Reliably Disconnect from the Lower Completion without Pulling the Entire Completion String," Aug. 2009, 2 pages, Halliburton.
WellDynamics brochure H06963 entitled, "Concentric Hydraulic Disconnect—Reliably Disconnect from ESP Applications without Pulling the Entire Completion," Aug. 2009, 2 pages, Halliburton.
Foreign communication from a related counterpart application—International Search Report and Written Opinion, PCT/US2012/050371, Mar. 5, 2013, 10 pages.
Office Action dated Jul. 9, 2013 (17 pages), U.S. Appl. No. 13/633,736, filed Oct. 2, 2012
Office Action (Final) dated Jan. 27, 2014 (13 pages), U.S. Appl. No. 13/633,736 filed on Oct. 2, 2012.

* cited by examiner

*Primary Examiner* — Nicole Coy
*Assistant Examiner* — Michael Wills, III
(74) *Attorney, Agent, or Firm* — Scott Wendorf Conley Rose, P.C.

(57) ABSTRACT

A hydraulic connection mechanism for use in a wellbore comprises an upper connection running tool, a lower connection tool configured to engage the upper connection running tool and form a fluid communication pathway through the hydraulic connection mechanism, and a debris barrier disposed in the fluid communication pathway. The debris barrier comprises a body element, and a spring element configured to maintain the body element in a closed position when the upper connection running tool is disengaged from the lower connection tool.

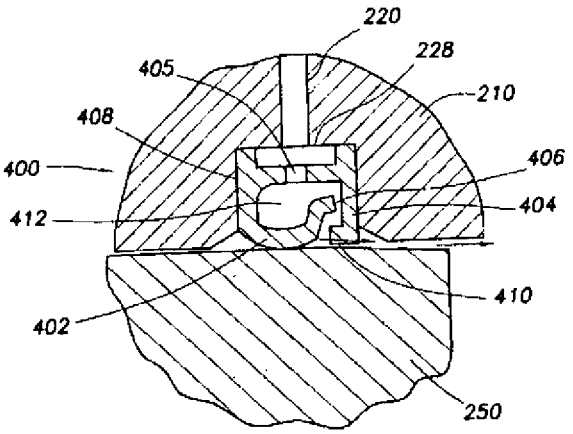

19 Claims, 10 Drawing Sheets